US010215014B2

(12) United States Patent
Dawson et al.

(10) Patent No.: US 10,215,014 B2
(45) Date of Patent: Feb. 26, 2019

(54) MAPPING OF FRACTURE GEOMETRIES IN A MULTI-WELL STIMULATION PROCESS

(71) Applicant: Reveal Energy Services, Inc., Houston, TX (US)

(72) Inventors: Matthew A. Dawson, Sugarland, TX (US); Günther Kampfer, Trondheim (NO); Lukas Mosser, London (GB)

(73) Assignee: Reveal Energy Services, Inc., Houston, TX (US)

( * ) Notice: Subject to any disclaimer, the term of this patent is extended or adjusted under 35 U.S.C. 154(b) by 0 days.

(21) Appl. No.: 15/201,470

(22) Filed: Jul. 3, 2016

(65) Prior Publication Data

US 2018/0003033 A1 Jan. 4, 2018

(51) Int. Cl.
*E21B 47/06* (2012.01)
*E21B 43/26* (2006.01)

(52) U.S. Cl.
CPC ..... *E21B 47/06* (2013.01); *E21B 43/26* (2013.01)

(58) Field of Classification Search
CPC ..... E21B 47/06; E21B 43/26; E21B 49/008
See application file for complete search history.

(56) References Cited

U.S. PATENT DOCUMENTS 9,187,992 B2 * 11/2015 Cherian ..... E21B 43/17
2009/0188665 A1 * 7/2009 Tubel ..... E21B 23/03 166/250.01
2009/0281776 A1 11/2009 Cheng et al.
2015/0083398 A1 * 3/2015 Dawson ..... E21B 43/16 166/245
2015/0176394 A1 * 6/2015 Roussel ..... E21B 43/26 166/250.1
2015/0241584 A1 8/2015 Aarre
2016/0061022 A1 3/2016 McCoy
2017/0002652 A1 * 1/2017 Kampfer ..... E21B 43/26
2017/0370208 A1 * 12/2017 Dawson ..... E21B 7/06

OTHER PUBLICATIONS

International Search Report and Written Opinion for Application No. PCT/US2017/039943 dated Sep. 25, 2017.

* cited by examiner

*Primary Examiner* — Michael R Wills, III
(74) *Attorney, Agent, or Firm* — Fish & Richardson P.C.

(57) ABSTRACT

Systems and methods for assessing geometric fractures parameters in a subsurface formation are disclosed. A first pressure signal and a second pressure signal in a first (observation) wellbore in the subsurface formation may be assessed using a pressure sensor in direct fluid communication with a fluid in the first wellbore. The fluid in the first wellbore may be in direct fluid communication with at least a first fracture in the subsurface formation. The first pressure signal may include a pressure change that is induced by a second fracture being formed from a second (stimulation) wellbore in the subsurface formation. The second pressure signal may include a pressure change that is induced by a third fracture being formed from the second wellbore. One or more geometric parameters of the second and third fractures may be assessed using the first pressure signal and the second pressure signal.

37 Claims, 9 Drawing Sheets

MAPPING OF FRACTURE GEOMETRIES IN A MULTI-WELL STIMULATION PROCESS

BACKGROUND

1. Technical Field

Embodiments described herein relate to systems and methods for subsurface wellbore completion and subsurface reservoir technology. More particularly, embodiments described herein relate to systems and methods for assessing geometric fracture properties in subsurface hydrocarbon-bearing formations.

2. Description of Related Art

Ultra-tight hydrocarbon-bearing formations (e.g., hydrocarbon-bearing resources) may have very low permeability compared to conventional resources. For example, the Bakken formation may be an ultra-tight hydrocarbon-bearing formation. These ultra-tight hydrocarbon-bearing formations are often stimulated using hydraulic fracturing techniques to enhance oil production. Long (or ultra-long) horizontal wells may be used to enhance production from these resources and provide production suitable for commercial production. However, even with these technological enhancements, these resources can be economically marginal and often only recover 5-15% of the original oil-in-place under primary depletion. Therefore, optimizing the development of this resource by optimizing the wellbore spacing and wellbore completions is critical.

Many different methods are currently be used to attempt to optimize wellbore spacing. One common method is the use of downspacing tests. In downspacing tests, varying well spacings are chosen for different pads and production is compared at different spacings to determine the best (optimal) spacing. Downspacing tests, however, can be expensive and time consuming. In addition, such tests may not provide an answer with high certainty and thus the procedure may need to be repeated many times to increase confidence in the result, which further increases costs and time. Downspacing tests may also include under drilling and/or over drilling numerous pads, which may significantly reduce the value of the resource by inefficiently developing it.

Another technique that has been widely adopted is the use of subsurface or surface microseismic arrays to monitor seismic events during the hydraulic fracturing process. Ideally, this technique provides insight into the dimensions of hydraulic fractures, which helps to determine the optimal well spacing. This technique, however, is often suspect for a number of reasons. A first, and foremost, reason is that microseismic predominantly identifies shear events, which may or may not be associated with the growth of hydraulic fractures. Microseismic events are caused by the creation and dilation of fractures but do not necessarily occur where the fracture fluid or even proppants are placed. The stress state in the rocks adjacent to the hydraulic fracture may be altered from its initial state and hence there are plenty of possible explanations for microseismic events (for example, by reactivating pre-existing planes of weakness or micro fractures within the surrounding rock which are not at all hydraulically connected to the well). Therefore there is a huge uncertainty on the hydraulic fracture geometry using microseismic techniques.

A second disadvantage with microseismic is that it requires knowledge of the subsurface, particularly wave velocities in the media, which are typically unknown and have high uncertainty. Finally, the processing methods for microseismic are typically operated by service companies that use veiled algorithms and have uncertain methods. Despite all these uncertainties and the significant cost of running microseismic, the value of understanding wellbore spacing is needed such that this technology has been widely applied in industry. There are also newer seismic approaches under development that utilize advanced proppants (e.g., tracer studies) or advanced imaging and data acquisition techniques (e.g., electromagnetic based imaging techniques). These approaches, however, are still in the research stage and may likely be costly and complex even if commercialized.

Yet another technique used to evaluate wellbore spacing is the use of pressure measurements. Pressure measurements have been done downhole and at the surface. Pressure tests have been performed during production, during shut-ins, and/or during hydraulic fracturing. For ultra-tight systems, pressure tests during production are rarely done, even though pressure tests are the most commonly employed method for conventional systems to evaluate reservoir performance or fracture geometry. The shut-in times and data acquisition times for pressure testing on unconventional reservoirs is often too long to justify pressure testing. When pressure tests are used during hydraulic fracturing processes, typically only hydraulic fracture hits (where fluid from a stimulated well reaches the well where you are monitoring pressure) are looked for during these tests. Looking for hydraulic fracture hits may give some insight into fracture geometry. Looking only at hydraulic (direct) fracture hits may provide some information but it doesn't distinguish between the different underlying processes that could contribute to these fracture hits (i.e., natural fracture networks, faults, or actual hydraulic fracture growth into an adjacent well). Additionally, direct fracture hits only provide a limited amount of information such as providing a single piece of information when fluid actually communicates with an adjacent well at a fixed distance from the stimulated well. The direct fracture pressure method cannot provide any information if the fluids do not reach the wellbore and it cannot provide accurate information about the final length of hydraulic fractures if they pass the wellbore and continue to grow. Moreover, in the case of cemented liners, fluid could readily pass an adjacent well and never register a direct fracture hit.

SUMMARY

In certain embodiments, a method of treating a subsurface formation includes assessing a first pressure signal in a first wellbore using a pressure sensor in direct fluid communication with a first fluid in the first wellbore. The first fluid in the first wellbore may be in direct fluid communication with a first fracture in the subsurface formation emanating from a selected interval in the first wellbore. The first pressure signal assessed in the first wellbore may include a pressure change induced by formation of a second fracture emanating from a first interval in a second wellbore in the subsurface formation. The second fracture may be in direct fluid communication with a second fluid in the second wellbore in the subsurface formation. A second pressure signal may be assessed in the first wellbore using the pressure sensor in direct fluid communication with the first fluid in the first wellbore. The second pressure signal assessed in the first wellbore may include a pressure change induced by formation of a third fracture emanating from a second interval in the second wellbore in the subsurface formation. The second interval in the second wellbore may be spatially separated from the first interval in the second wellbore. The third fracture may be in direct fluid communication with a third fluid in the second wellbore in the subsurface formation. A first spatial location of a part of the first interval in the second wellbore may be assessed relative to the selected interval in the first wellbore. A second spatial location of a part of the second interval in the first wellbore may be assessed relative to the selected interval in the first wellbore. One or more geometric parameters of the second fracture and the third fracture may be assessed using the first pressure signal and the second pressure signal in combination with the first assessed spatial location and the second assessed spatial location.

In certain embodiments, a system for assessing one or more geometric parameters of fractures in a subsurface formation includes a first wellbore in the subsurface formation and a second wellbore in the subsurface formation. At least a first fracture may emanate from a selected interval in the first wellbore. The first fracture may be in direct fluid communication with a first fluid in the first wellbore. A second fracture may be configured to be formed from a first interval in the second wellbore and in direct fluid communication with a second fluid in the second wellbore. A third fracture may be configured to be formed from a second interval in the second wellbore and in direct fluid communication with a third fluid in the second wellbore. The second interval in the second wellbore may be spatially separated from the first interval in the second wellbore. A pressure sensor may be in direct fluid communication with the first fluid in the first wellbore. A computer processor that receives one or more pressure signals from the pressure sensor may be configured to assess a first pressure signal from the pressure sensor while the second fracture is being formed and assess a second pressure signal from the pressure sensor while the third fracture is being formed. The first pressure signal may be induced by formation of the second fracture and the second pressure signal being induced by formation of the third fracture. The computer processor may be configured to: assess a first spatial location of a part of the first interval in the second wellbore relative to the selected interval in the first wellbore; assess a second spatial location of a part of the second interval in the second wellbore relative to the selected interval in the first wellbore; and assess one or more geometric parameters of the second fracture and the third fracture using the first pressure signal and the second pressure signal in combination with the first assessed spatial location and the second assessed spatial location.

In certain embodiments, a method for treating a subsurface formation includes assessing a first pressure signal in a first wellbore using a pressure sensor in direct fluid communication with a first fluid in the first wellbore. The first fluid in the first wellbore may be in direct fluid communication with a first fracture in the subsurface formation emanating from a selected interval in the first wellbore. The first pressure signal assessed in the first wellbore may include a pressure change induced by formation of a second fracture emanating from a first interval in a second wellbore in the subsurface formation. The second fracture may be in direct fluid communication with a second fluid in the second wellbore in the subsurface formation. A second pressure signal in the first wellbore may be assessed using the pressure sensor in direct fluid communication with the first fluid in the first wellbore. The second pressure signal assessed in the first wellbore may include a pressure change induced by formation of a third fracture emanating from a second interval in the second wellbore in the subsurface formation. The second interval in the second wellbore may be spatially separated from the first interval in the second wellbore. The third fracture may be in direct fluid communication with a third fluid in the second wellbore in the subsurface formation. Using a simulation on a computer processor, a first simulated fracture geometry may be determined for the second fracture emanating from the second wellbore. The first simulated fracture geometry may be determined as a simulated fracture geometry selected from a plurality of simulated fracture geometries that provides a minimum in a total error between at least two simulated pressure signals and the assessed pressure signals for the plurality of simulated fracture geometries. The total error may be a sum of a first error between a first simulated pressure signal and the first assessed pressure signal and a second error between a second simulated pressure signal and the second assessed pressure signal. The first simulated pressure signal and the second simulated pressure signal may be determined for the first simulated fracture geometry based on a spatial relationship between the second fracture and the first fracture, a spatial relationship between the first interval and the second interval in the second wellbore, and a net pressure applied in the second wellbore.

In some embodiments, beginning with the first simulated fracture geometry, a selected simulated fracture geometry may be determined for the second fracture. The selected simulated fracture geometry for the second fracture may provide a minimum in the first error between the first simulated pressure signal and the first assessed pressure signal. Beginning with the first simulated fracture geometry, a selected simulated fracture geometry may be determined for the third fracture. The selected simulated fracture geometry for the third fracture may provide a selected minimum in the second error between the second simulated pressure signal and the second assessed pressure signal.

In certain embodiments, a system for assessing one or more geometric parameters of fractures in a subsurface formation includes a first wellbore in the subsurface formation and a second wellbore in the subsurface formation. At least a first fracture may emanate from a selected interval in the first wellbore. The first fracture may be in direct fluid communication with a first fluid in the first wellbore. A second fracture may be configured to be formed from a first interval in the second wellbore and in direct fluid communication with a second fluid in the second wellbore. A third fracture may be configured to be formed from a second interval in the second wellbore and in direct fluid communication with a third fluid in the second wellbore. The second interval in the second wellbore may be spatially separated from the first interval in the second wellbore. A pressure sensor may be in direct fluid communication with the first fluid in the first wellbore. A computer processor that receives one or more pressure signals from the pressure sensor may be configured to assess a first pressure signal from the pressure sensor while the second fracture is being formed and assess a second pressure signal from the pressure sensor while the third fracture is being formed. The first pressure signal may be induced by formation of the second fracture and the second pressure signal being induced by formation of the third fracture. The computer processor may be configured to: determine, using a simulation on the computer processor, a first simulated fracture geometry for the second fracture emanating from the second wellbore, wherein the first simulated fracture geometry is determined as a simulated fracture geometry selected from a plurality of simulated fracture geometries that provides a minimum in a total error between at least two simulated pressure signals and the assessed pressure signals, the total error being a sum of a first error between a first simulated assessed pressure signal and the first pressure signal and a second error between a second simulated pressure signal and the second assessed pressure signal; wherein the first simulated pressure signal and the second simulated pressure signal are determined for the first simulated fracture geometry based on a spatial relationship between the second fracture and the first fracture, a spatial relationship between the first interval and the second interval in the second wellbore, and a net pressure applied in the second wellbore.

In certain embodiments, a non-transient computer-readable medium including instructions that, when executed by one or more processors, causes the one or more processors to perform a method that includes one or more of the methods described above.

BRIEF DESCRIPTION OF THE DRAWINGS

Features and advantages of the methods and apparatus of the embodiments described in this disclosure will be more fully appreciated by reference to the following detailed description of presently preferred but nonetheless illustrative embodiments in accordance with the embodiments described in this disclosure when taken in conjunction with the accompanying drawings in which.

Figure 1:
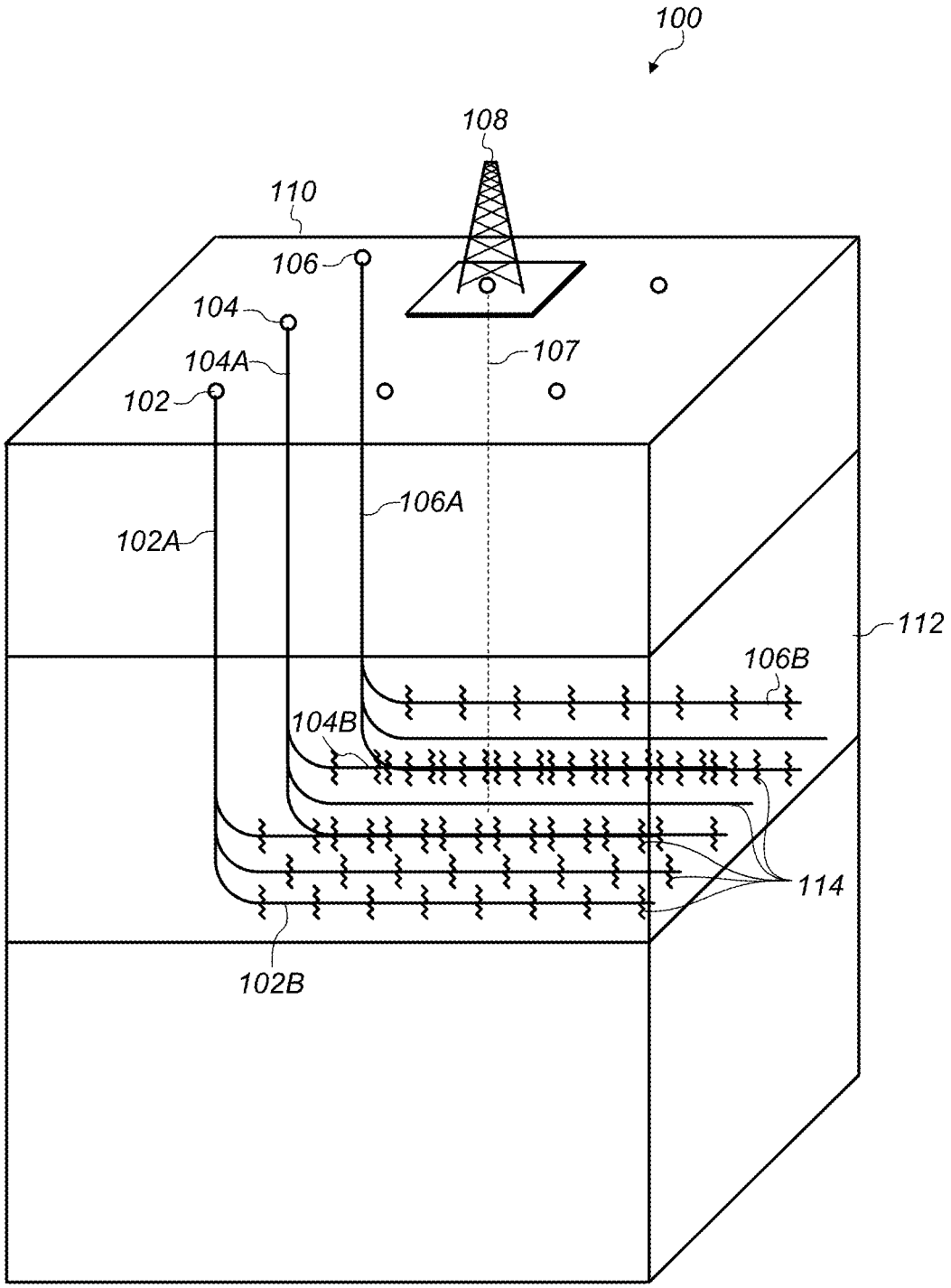
FIG. 1 depicts an example of an embodiment of a drilling operation on a multi-well pad.

While embodiments described in this disclosure may be susceptible to various modifications and alternative forms, specific embodiments thereof are shown by way of example in the drawings and will herein be described in detail. It should be understood, however, that the drawings and detailed description thereto are not intended to limit the embodiments to the particular form disclosed, but on the contrary, the intention is to cover all modifications, equivalents and alternatives falling within the spirit and scope of the appended claims. The headings used herein are for organizational purposes only and are not meant to be used to limit the scope of the description. As used throughout this application, the word "may" is used in a permissive sense (i.e., meaning having the potential to), rather than the mandatory sense (i.e., meaning must). Similarly, the words "include", "including", and "includes" mean including, but not limited to.

Various units, circuits, or other components may be described as "configured to" perform a task or tasks. In such contexts, "configured to" is a broad recitation of structure generally meaning "having circuitry that" performs the task or tasks during operation. As such, the unit/circuit/component can be configured to perform the task even when the unit/circuit/component is not currently on. In general, the circuitry that forms the structure corresponding to "configured to" may include hardware circuits and/or memory storing program instructions executable to implement the operation. The memory can include volatile memory such as static or dynamic random access memory and/or nonvolatile memory such as optical or magnetic disk storage, flash memory, programmable read-only memories, etc. The hardware circuits may include any combination of combinatorial logic circuitry, clocked storage devices such as flops, registers, latches, etc., finite state machines, memory such as static random access memory or embedded dynamic random access memory, custom designed circuitry, programmable logic arrays, etc. Similarly, various units/circuits/components may be described as performing a task or tasks, for convenience in the description. Such descriptions should be interpreted as including the phrase "configured to." Reciting a unit/circuit/component that is configured to perform one or more tasks is expressly intended not to invoke 35 U.S.C. § 112(f) interpretation for that unit/circuit/component.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

DETAILED DESCRIPTION OF EMBODIMENTS

This specification includes references to "one embodiment" or "an embodiment." The appearances of the phrases "in one embodiment" or "in an embodiment" do not necessarily refer to the same embodiment, although embodiments that include any combination of the features are generally contemplated, unless expressly disclaimed herein. Particular features, structures, or characteristics may be combined in any suitable manner consistent with this disclosure.

Fractures in subsurface formations as described herein are directed to fractures created hydraulically. It is to be understood, however, that fractures created by other means (such as thermally or mechanically) may also be treated using the embodiments described herein.

FIG. 1 depicts an example of an embodiment of a drilling operation on a multi-well pad. It is to be understood that the drilling operation shown in FIG. 1 is provided for exemplary purposes only and that a drilling operation suitable for the embodiments described herein may include many different types of drilling operations suitable for hydraulic fracturing of hydrocarbon-bearing subsurface formations and/or other fracture treatments for such formations. For example, the number of groups of wellbores and/or the number of wellbores in each group are not limited to those shown in FIG. 1. It should also be noted that the wellbores may be, in some cases, be vertical wellbores without horizontal sections.

In certain embodiments, as depicted in FIG. 1, drilling operation 100 includes groups of wellbores 102, 104, 106 drilled by drilling rig 108 from single pad 110. Wellbores 102, 104, 106 may have vertical sections 102A, 104A, 106A that extend from the surface of the earth until reaching hydrocarbon-bearing subsurface formation 112. In formation 112, wellbores 102, 104, 106 may include horizontal sections 102B, 104B, 106B that extend horizontally from vertical sections 102A, 104A, 106A into formation 112. Horizontal sections 102B, 104B, 106B may increase or maximize the efficiency of oil recovery from formation 112. In certain embodiments, formation 112 is hydraulically stimulated using conventional hydraulic fracturing methods. Hydraulic stimulation may create fractures 114 in formation 112. It is to be understood that while FIG. 1 illustrates that several groups of wellbores 102, 104, 106 reach the same formation 112, this is provided for exemplary purposes only and, in some embodiments, the groups and the wellbores in different groups can be in different formations. For example, the groups and the wellbores may be in two different formations. According to an embodiment of the present invention, a method has been developed for evaluating hydraulic fracture geometry and optimizing well spacing for a multi-well pad by sequencing hydraulic fracturing jobs for the multi-well pad and monitoring the pressure in said monitor well while hydraulic fractures are created in adjacent well(s), so that highly valuable data can be acquired for analyzing to evaluate hydraulic fracture geometry, proximity, and connectivity.

Figure 2:
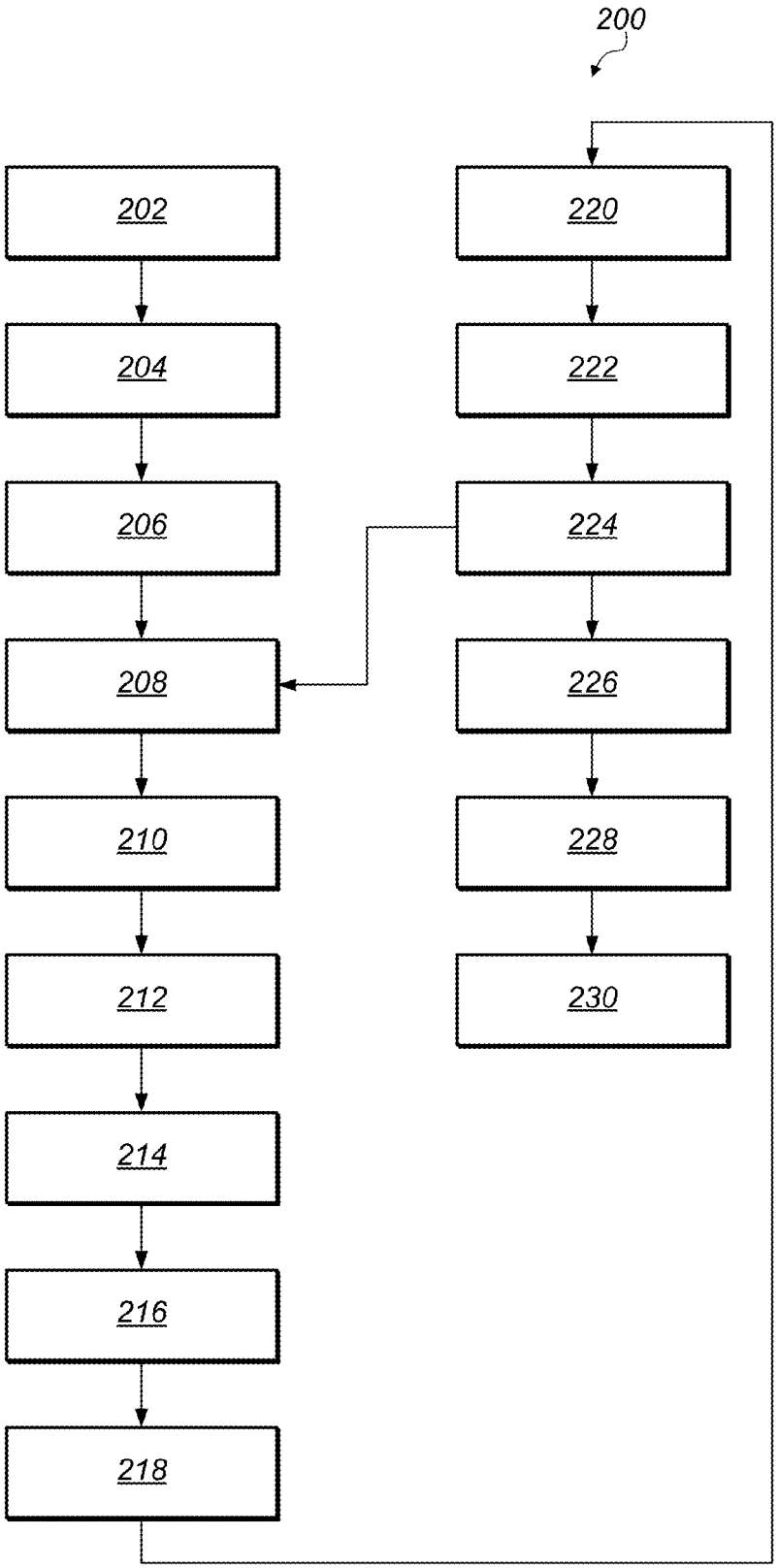
FIG. 2 depicts a flowchart of an embodiment of a process for assessing pressure signal data used to evaluate hydraulic fracturing in a hydrocarbon-bearing subsurface formation.

FIG. 2 depicts a flowchart of an embodiment of process 200 for assessing pressure signal data used to evaluate hydraulic fracturing in hydrocarbon-bearing subsurface formation 112. In certain embodiments, process 200 is used to assess pressure between two wellbores in formation 112. In some embodiments, however, process 200 is used to assess pressure between three or more wellbores and/or wellbores in multiple groups of wellbores in formation 112.

In certain embodiments, at least two wellbores targeted for multi-stage hydraulic fracturing are identified in 202. In 204, a monitoring wellbore is selected from the at least two wellbores. After the monitoring wellbore is selected, in 206, a pressure sensor (e.g., pressure gauge) is connected in direct fluid communication with the monitoring wellbore in order to monitor the pressure changes in the wellbore. The pressure sensor may be, but is not limited to, a surface pressure gauge or a subsurface pressure gauge. Surface pressure gauges may be simpler and less costly. Typically, surface gauges have been used for evaluating direct communication between wellbores and have not been used for determining hydraulic fracture properties such as proximity, geometry, overlap, etc. In certain embodiments, the surface gauge is used to acquire pressure information associated with an isolated observation stage in the monitoring wellbore. The surface gauge may also allow for a resting period so that the proximity and overlap of new fractures growing near the observation fractures may be determined using pressure signals recorded during the waiting period. Examples of subsurface gauges include, but are not limited to, downhole gauges, fiber gauges, or memory gauges. In some embodiments, subsurface gauges are placed in a plug (e.g., a bridge plug) used between stages. In some embodiments, the pressure gauge is a high-quality gauge with resolution below 1 psi (e.g., resolution of 0.1 psi) and a range of up to 10,000 psi. In certain embodiments, the surface pressure gauge is isolated. For example, the valve connecting the pressure gauge and the monitoring well is maintained closed from the wellbore during stimulation of the monitoring wellbore. In certain embodiments, the surface pressure gauge is not isolated. For example, the valve connecting the pressure gauge and the monitoring well is maintained opened to the wellbore during stimulation of adjacent wellbores.

In 208, a stage targeted for hydraulic fracturing of the monitoring wellbore is selected to be the observation stage. It is to be understood that any wellbore can be set as the monitor wellbore, and any stage from the first stage and up can be set as the observation stage. In 210, fractures may be created in the monitoring wellbore up to the stage immediately before the observation stage. The fracturing operation may be carried out using any suitable conventional hydraulic fracturing methods. The fractures emanating from the monitoring wellbore are in contact with a hydrocarbon-bearing subterranean formation (e.g., formation 112), which can be the same as the hydrocarbon-bearing subterranean formation being contacted with the fractures created in adjacent wellbore(s), or may be a different formation. In some embodiments, the fracturing operation includes sub-steps of: drilling a wellbore (borehole) vertically or horizontally; inserting production casing into the borehole and then surrounding with cement; charging inside a perforating gun to blast small holes into the formation; and pumping a pressurized mixture (fluid) of water, sand, and chemicals into the wellbore. The pressurized fluid may generate numerous fractures in the formation that will free trapped oil to flow to the surface. It is to be understood that the fracturing operation may be carried out using any suitable conventional hydraulic fracturing method known in the art and is not limited to the above mentioned sub-steps. In some embodiments, fractures may also be created in one or more adjacent wellbores while creating fracturing in the monitoring wellbore.

In some embodiments, after the fractures are created in the monitoring wellbore up to immediately before the observation stage, in 212, the observation stage may be isolated from the previously completed stages by an isolating device and/or sliding sleeves. The isolating device may be, but is not limited to, a bridge plug installed internally in the monitoring wellbore while swell-packers exist externally around the wellbore before the observation stage. For example, if the observation stage is set to be stage 11 of the monitoring wellbore, the bridge plug should be installed after stage 10. The bridge plug may be retrievable and set in compression and/or tension and installed in the monitoring wellbore before the observation stage. In some embodiments, the bridge plug is non-retrievable and drilled out after the completions are finished. Other suitable isolation devices known in the art may also be used. In other embodiments, there is no isolation inside the wellbore between the observation stage in the monitoring wellbore and the stage prior to the observation stage in the monitoring wellbore.

In some embodiments, after the observation stage in the monitoring wellbore is isolated from the previously completed stages, in 214, a fracture may be created in the observation stage. In certain embodiments, during 214, the valve connecting the pressure gauge and the monitoring well may still remain closed. The fracturing operation may be carried out using any suitable conventional hydraulic fracturing method. The fracture emanating from this stage may be in contact with a hydrocarbon-bearing subsurface formation (e.g., formation 112). Step 214 may be used to ensure that there is sufficient mobile fluid to accommodate the compressibility in the monitoring wellbore and deliver the actual subsurface pressure signal. In some embodiments, during 214, the monitoring (observation) wellbore is perforated without creating a fracture in the formation. Perforation of the monitoring wellbore may create fluid communication between the wellbore and the formation that allows pressure measurement of the subsurface pressure signal in the wellbore. In other embodiments, a fracture is created in the observation stage without isolation in the wellbore between the observation stage and the stage prior to the observation stage within the monitoring well.

After completion of the observation stage, in 216, the valve for the pressure gauge connecting with the monitoring well may be opened such that the pressure gauge is in direct fluid communication with the observation stage in the monitoring wellbore. In some embodiments, the next stage in the monitoring wellbore may not be perforated until the pressure monitoring is completed. For example, if stage 11 of the monitoring wellbore is set to be the observation stage, stage 12 should not be perforated until the pressure monitoring for observation stage 11 is completed.

After the valve for the pressure gauge is opened, in 218, fracturing operations are performed in one or more adjacent wellbores that are in contact with the hydrocarbon-bearing subsurface formation. The adjacent wellbore may be adjacent to the monitor wellbore such that the fractures formed from the adjacent wellbore induce the pressure being measured in the monitoring wellbore to change (e.g., the fractures induce pressure changes in the monitoring wellbore). An adjacent wellbore may not be limited to an immediately adjacent wellbore or even a wellbore in the same formation or stratigraphic layer. For example, as long as the fractures from the "adjacent" wellbore may induce the pressure being measured in the monitoring wellbore to change, the wellbore may be considered an adjacent wellbore. In certain embodiments, the number of stages completed in each of the adjacent wellbores exceeds the number of stages completed in the monitoring wellbore.

In certain embodiments, at least two stages before the observation stage and at least two stages after the observation stage in the adjacent wellbore should be completed in 218 while the pressure in the monitoring wellbore is monitored by the pressure gauge. For example, if stage 11 of the monitoring wellbore is set to be the observation stage, at least stages 9-13 in the adjacent wellbore should be completed in 218 while the pressure in the monitoring well is monitored by the pressure gauge. In some embodiments, at least four stages before the observation stage and at least four stages after the observation stage in the adjacent wellbore should be completed in 218. In some embodiments, the stage numbers in the monitoring wellbore and the adjacent wellbore may or may not correspond to each other depending on the wellbore length, stage placement, and fracture orientation. When the stage numbers in the monitoring wellbore and the adjacent wellbore do not correspond to each other, the stages being completed in the adjacent wellbore, while the pressure in the monitoring wellbore is monitored by the pressure gauge, typically include stages both before and after the observation stage. In some cases, it may be possible to include stages other than those before and after the observation stage. For example, if there are fractures at a 45° angle, stages further away may be monitored (e.g., stage 10 observation stage may be used to monitor while stages 14-18 are completed in the adjacent well). Determining the monitoring stage numbers and identifying the adjacent wellbore stages influencing the pressure in the monitoring stage may not be straight forward. For example, the wellbores may not be drilled in alignment with the minimum horizontal compressive stress direction, since in such a case the induced fractures may be oblique to the well axis. In such embodiments, however, data collection may be enhanced because the dataset is very rich, covering a large space on the pore pressure map. During 218, no molecule contained in the fracture created in the monitoring wellbore physically interacts with a molecule contained in the fracture created in the adjacent wellbore, and no molecule existing in the fracture created in the monitoring wellbore exists in the fracture created in the adjacent wellbore simultaneously.

The measured pressures may be recorded (assessed) in 220. After the monitoring is completed, in 222, the valve connecting the pressure gauge and the monitoring wellbore may be closed. Further fracturing operations may then be performed in the next stage in the monitoring wellbore. In 224, a determination may be made to decide whether more data is needed, and if yes, one or more steps in process 200 (including steps 208-224) may be repeated as many times as desired. The repeating operation may start with selecting a new observation stage. In certain embodiments, two or three observation stages are selected for process 200 in one monitoring wellbore. In some embodiments, however, more than one monitoring wellbore may be used, and in such embodiments, one observation stage per monitoring wellbore may be sufficient.

Figure 3:
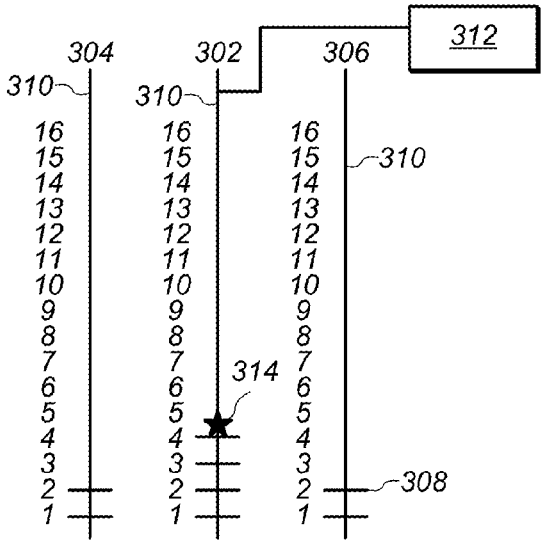
FIG. 3 shows a group of wellbores represented by vertical lines including three wellbores.
Figure 4:
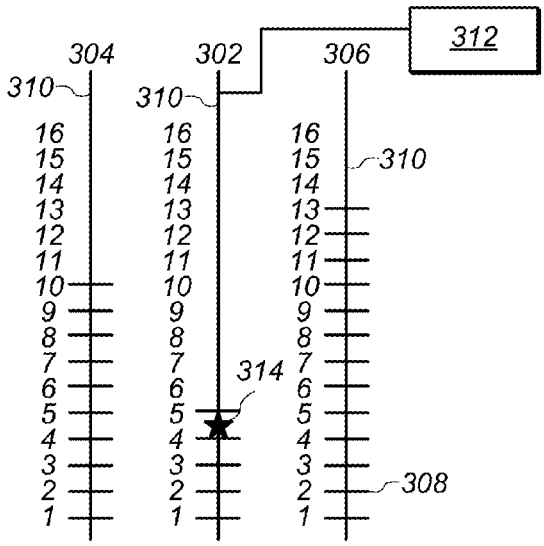
FIG. 4 shows a group of wellbores after a stage of a wellbore is isolated.
Figure 5:
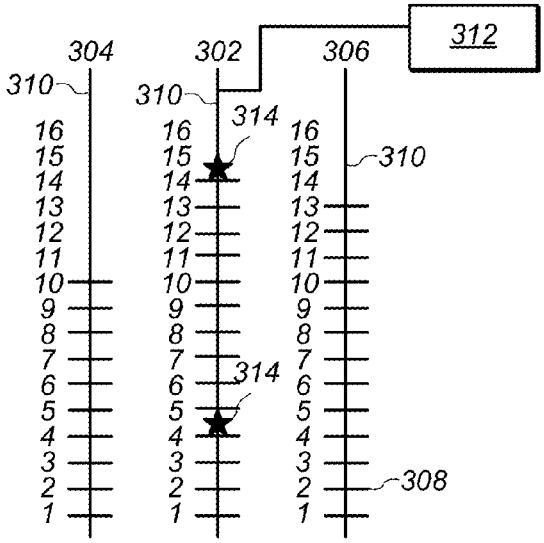
FIG. 5 shows a group of wellbores after the monitoring is completed.

FIGS. 3-5 depict diagrams of an example of an embodiment of the stage sequencing of a hydraulic fracturing operation for a multi-well pad. FIG. 3 shows a group of wellbores represented by the vertical lines 300 including three wellbores—wellbore 302, wellbore 304, and wellbore 306. It is to be understood that the numbers of groups of wellbores and the types of wellbores in terms of the formation are not limited to those shown in FIGS. 3-5. In some embodiments, wellbore 302, wellbore 304, and wellbore 306 are not limited to be in the same formation and they may be in different formations. In certain embodiments, horizontal lines 308 intersecting vertical lines 310 illustrate fractures created in each wellbore. The numbers beside horizontal lines 308 illustrate the sequencing of the stages in each wellbore. As shown in FIG. 3, wellbore 302 is selected to be the monitor well, and stage 5 of wellbore 302 is set to be the observation stage. Pressure gauge 312 may be connected to the monitoring wellbore (wellbore 302), and the valve connecting the pressure gauge and the monitoring wellbore remains closed until the observation stage is completed. Two stages have been completed in each of wellbore 304 and wellbore 306. For the monitoring wellbore, wellbore 302, since stage 5 has been set to be the observation stage, the fracturing operations are performed up to stage 4. The number of stages completed in each wellbore is not limited to the illustration in FIG. 3. In certain embodiments, as shown in FIG. 3, however, the stress orientations are chosen such that the number of stages completed in wellbore 302 at this time exceed the number of stages completed in each of wellbore 304 and wellbore 306. After stage 4 of wellbore 302 is completed, a bridge plug, represented by star 314, is installed between stage 4 and stage 5 in the wellbore. Bridge plug 314 may isolate stage 5, the observation stage, from the previously completed stages in wellbore 302.

Turning to FIG. 4, after stage 5 of wellbore 302 is isolated, a fracture is created in stage 5. After the fracturing of stage 5 in wellbore 302 is completed, the valve connecting pressure gauge 312 to the wellbore is opened such that the pressure gauge is in direct fluid communication with the isolated stage 5 in the wellbore. At this time, stage 6 in wellbore 302 has not yet been prepared by plugging and perforating. The plugging and perforating operation mentioned herein may adopt any suitable conventional systems such as, but not limited to, the open-hole (OH) graduated ball-drop fracturing isolation system where the ball isolates the next stage from the previous stage. In some embodiments sliding sleeves may be used to isolate stages. "Direct fluid communication" may be defined as a measureable pressure response in pressure gauge 312 induced by advective or diffusive mass transport. After the valve for connecting pressure gauge 312 to wellbore 302 is opened and the pressure gauge is in direct fluid communication with the isolated stage 5 in the wellbore, another eight stages of fracturing operations have been performed in wellbore 304 and another twelve stages of fracturing operations have been performed in wellbore 306, while pressure gauge 312 is monitoring the pressure changes in wellbore 302. Since wellbore 304 and wellbore 306 are adjacent wellbores of the monitor wellbore (wellbore 302), the fracturing operations performed in wellbore 304 and wellbore 306 induce the pressure being measured by pressure gauge 312 in wellbore 302 to change. The pressure change may be recorded (assessed) for further processing as described herein.

Turning to FIG. 5, after the monitoring is completed, the valve for connecting pressure gauge 312 to wellbore 302 may be closed. Stage 6 in wellbore 302 may then be plugged and perforated for preparation of performing a fracturing operation. In the embodiment shown in FIG. 5, a determination for obtaining more monitoring data is made, and a repeating operation, as in process 200 mentioned above, may be performed. As shown in FIG. 5, stage 15 in wellbore 302 may be set to be the new observation stage, and then fracturing operations are performed in stage 6 to stage 14 in the wellbore. After setting the new observation stage, the new observation stage, stage 15, may be isolated from the previously completed stages, for example, by installing bridge plug 314 between stage 14 and stage 15 in wellbore 302. After isolating stage 15, the procedure as mentioned above in process 200 may be performed. The pressure assessment operation may be performed and repeated as many times as desired until sufficient pressure monitoring data is obtained.

Figure 6:
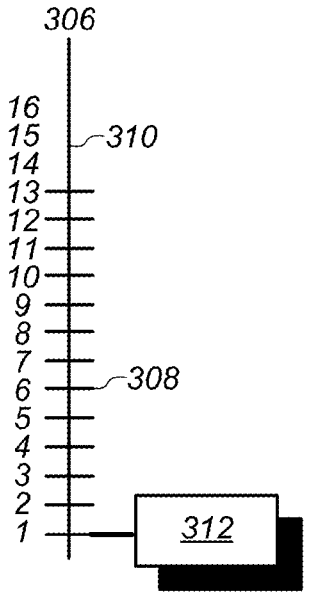
FIG. 6 depicts a stimulation wellbore with an observation stage and a stimulation stage.

In some embodiments, in 220, shown in FIG. 2, the pressure signal is measured in the stimulation wellbore. For example, the pressure signal may be measured in another stage in the stimulation wellbore such as a previous stage. FIG. 6 depicts stimulation wellbore 306 with stage (interval) 1 being used as an observation stage and stage (interval) 2 being used as a stimulation stage. In certain embodiments, pressure gauge 312 is placed in the observation stage (e.g., stage 1). Pressure gauge 312 may be, for example, a downhole pressure gauge, a fiber gauge, or a memory gauge. In some embodiments, pressure gauge 312 is placed in a plug (e.g., a bridge plug) between stages. For example, pressure gauge 312 may be a memory gauge in the plug between stage 1 and stage 2. In certain embodiments, pressure gauge 312 in stage 1 is used to measure the pressure signal induced by fracturing being completed from stage 2.

Figure 7:
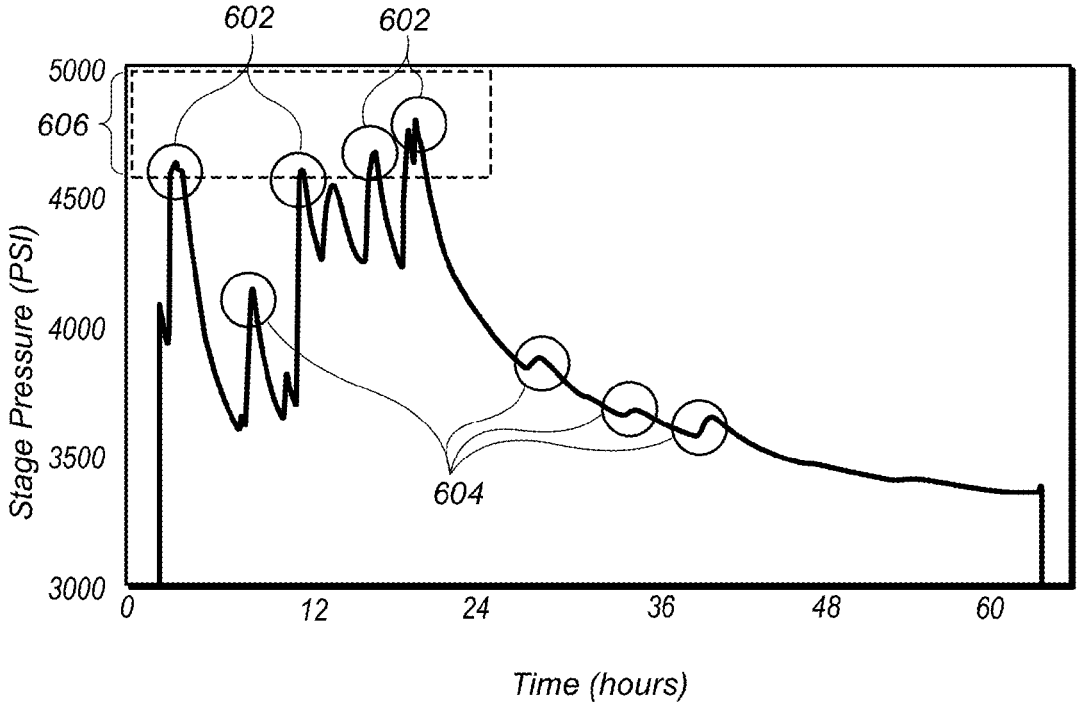
FIG. 7 depicts an example of a pressure versus time curve.

FIG. 7 depicts an example of a pressure versus time curve (e.g., a pressure log) that may be obtained using process 200 and the monitoring wellbore described above. In certain embodiments, the pressure versus time curve (curve 600 shown in FIG. 7) is for a single observation stage in an observation wellbore during multiple stages of injection in a stimulation wellbore. As described herein, a stage of injection may include a time from the start of injection (e.g., start injecting fracturing fluid), time for injection, stopping of on injection, and a selected time after injection is stopped (e.g., a time for additional fluid flow/pressure flow after injection is stopped). In some embodiments, a stage of injection may include multiple start/stop cycles of injection (e.g., multiple start/stop stages are completed on a single wellbore stage before isolation of the wellbore stage).

In certain embodiments, as shown in FIG. 2, process 200 includes identifying one or more pressure-induced poromechanic signals 226. The pressure-induced poromechanic signals may be identified using pressure signals (e.g., a pressure log) assessed in 220. In certain embodiments, the pressure signals or pressure log include a pressure versus time curve (such as curve 600 shown in FIG. 7) of the pressure signal assessed in 220. Pressure-induced poromechanic signals may be identified in the pressure versus time curve and the pressure-induced poromechanic signals may be used to assess one or more parameters (e.g., geometry) of the fracture system in the hydrocarbon-bearing subsurface formation.

As used herein, a "pressure-induced poromechanic signal" refers to a recordable change in pressure of a first fluid in direct fluid communication with a pressure sensor (e.g., pressure gauge) where the recordable change in pressure is caused by a change in stress on a solid in a subsurface formation that is in contact with a second fluid, which is in direct fluid communication with the first fluid. The change in stress of the solid may be caused by a third fluid used in a hydraulic stimulation process (e.g., a hydraulic fracturing process) in a stimulation wellbore in proximity to (e.g., adjacent) the observation (monitoring) wellbore with the third fluid not being in direct fluid communication with the second fluid.

For example, a pressure-induced poromechanic signal may occur in a surface pressure gauge attached to the wellhead of an observation wellbore, where at least one stage of that observation wellbore has already been hydraulically fractured to create a first hydraulic fracture, when an adjacent stimulation wellbore undergoes hydraulic stimulation. A second fracture emanating from the stimulation wellbore may grow in proximity to the first fracture but the first and second fractures do not intersect. No fluid from the hydraulic fracturing process in the stimulation wellbore contacts any fluid in the first hydraulic fracture and no measureable pressure change in the fluid in the first hydraulic fracture is caused by advective or diffusive mass transport related to the hydraulic fracturing process in the stimulation wellbore. Thus, the interaction of the fluids in the second fracture with fluids in the subsurface matrix does not result in a recordable pressure change in the fluids in the first fracture that can be measured by the surface pressure gauge. The change in stress on a rock in contact with the fluids in the second fracture, however, may cause a change in pressure in the fluids in the first fracture, which can be measured as a pressure-induced poromechanic signal in a surface pressure gauge attached to the wellhead of the observation wellbore.

The term "direct fluid communication" between a first fluid and a second fluid as used herein refers to an instance where the motion of a first fluid or the change in a state property (e.g., pressure) of a first fluid has the ability to directly influence a measureable change in the pressure of the second fluid through direct contact between the fluids. For example, water molecules on one side of the pool are in direct fluid communication with water molecules on the other side of the pool. Similarly, water molecules near the surface pressure gauge in an observation wellbore are in direct fluid communication with water molecules in the observation wellbore in the subsurface formation, provided there is no barrier in between the fluids. Fluid molecules in the observation wellbore in the subsurface formation may be in direct fluid communication with fluid molecules in a hydraulic fracture emanating from the observation wellbore, provided there is no barrier in between and the permeability of the hydraulic fracture is sufficient to allow fluid motion in the hydraulic fracture to influence the pressure of fluid molecules in the observation wellbore. In shale formations and ultra-low permeability formations, however, the permeability can be extremely low, in some cases less than 1 millidarcy, in some cases less than 1 microdarcy, and in some cases less than 10 nanodarcy. In such formations, fluid molecules in a first fracture emanating from an observation wellbore are not in direct fluid communication, as defined herein, with fluid molecules in an unconnected second fracture emanating from a stimulation wellbore when an ultra-low permeability formation with 90% of the bulk volume of the formation separating the fractures has a permeability less than 0.1 millidarcy or less than 0.01 millidarcy.

Poromechanic signals may be present in traditional pressure measurements taken in an observation wellbore while fracturing an adjacent well. For example, if a newly formed hydraulic fracture overlaps or grows in proximity to a hydraulic fracture in fluid communication with the pressure gauge in the observation wellbore, one or more poromechanic signals may be present. However, poromechanic signals may be smaller in nature than a direct fluid communication signal (e.g., a direct pressure signal induced by direct fluid communication such as a direct fracture hit or fluid connectivity through a high permeability fault). Poromechanic signals may also manifest over a different time scale that direct fluid communication signals. Thus, poromechanic signals are often overlooked, unnoticed, or disregarded as data drift or error in the pressure gauges themselves.

Poromechanic signals, however, may represent important physical processes in the subsurface that heretofore have not been recognized. Typically, poromechanic signals are not sought for when looking at pressure data from an adjacent well during a fracturing process as they do not represent direct fracture hit signals. Poromechanic signals may be used to gain greater insight into hydraulic fracture geometries than other pieces of data that are currently collected to understand the hydraulic fracturing process. Recent developments for shale formations have provided the ability to map hydraulic fractures by coupling knowledge of solid mechanics and fluid mechanics and use poromechanic theory on such formations (described herein and in U.S. patent application Ser. No. 14/788,056 entitled "INTEGRATED MODELING APPROACH FOR GEOMETRIC EVALUATION OF FRACTURES (IMAGE FRAC)" to Kampfer and Dawson, which is incorporated by reference as if fully set forth herein). Poromechanic signals within pressure signal data (e.g., pressure versus time curves such as curve 600, shown in FIG. 7) need to be identified in order to use the poromechanic theory map hydraulic fractures. Identifying poromechanic signals may include differentiating the poromechanic signals from signals caused by direct fluid connectivity (e.g., direct pressure signals induced by direct fluid communication).

Direct fluid connectivity signals may be classified into three main classes. The first class may arise when a "direct fracture hit occurs". A direct fracture hit may be defined as a case where a hydraulically created fracture in a stimulated wellbore intersects hydraulic fractures (existing or being created) emanating from an observation wellbore or intersects the observation wellbore itself. The intersection of fractures allows fluid from the stimulated fracture to contact fluid in direct communication with the pressure gauge in the observation wellbore. The second class may arise when a hydraulically created fracture intersects a fault or high permeability channel in the formation. The fault or high permeability channel may also intersect a fracture emanating from the observation wellbore or intersect the observation wellbore itself. The third class may arise when a natural fracture or low-permeability channel allows for fluid communication between a hydraulically created fracture in a stimulated wellbore and fluid in communication with the observation wellbore (residing either in the wellbore itself or in a hydraulically created fracture emanating from the observation wellbore).

In certain embodiments, identifying one or more pressure-induced poromechanic signals 226, shown in FIG. 2, includes differentiating the pressure-induced poromechanic signals from pressure signals due to one of the three classes of direct fluid connectivity signals (e.g., direct pressure signals induced by direct fluid communication between the stimulation wellbore and the observation wellbore). Pressure-induced poromechanic signals may be differentiated from direct pressure signals using one or more different selected criteria that can be observed in a pressure versus time curve such as curve 600, shown in FIG. 7. Curve 600 includes examples of direct pressure signals 602 and examples of pressure-induced poromechanic signals 604. It is to be understood that signals 602 and signals 604 on curve 600, shown in the representative embodiment of FIG. 7, are provided as examples of different types of pressure signals that may be seen but that these examples are not exclusive and application of the criteria described below may be used to differentiate pressure-induced poromechanic signals from direct pressure signals for various embodiments of pressure versus time curves. In certain embodiments, a poromechanic signal is differentiated from a direct fracture hit induced signal using the time rate of change of a pressure-induced poromechanic signal during the hydraulic fracturing process (e.g., during stimulation in the stimulated wellbore).

In certain embodiments, a poromechanic signal is differentiated from a direct fracture hit induced signal using the time rate of change of a pressure-induced poromechanic signal during the hydraulic fracturing process (e.g., during stimulation in the stimulated wellbore).

In certain embodiments, a poromechanic signal is differentiated from a direct fracture hit by the difference in absolute magnitude of a pressure increase in the pressure signal (e.g., the difference in pressure between a starting pressure and a peak pressure for a pressure change). In some embodiments, the magnitude of the pressure change of the poromechanic signal is less than the magnitude of the pressure change of the direct fracture hit induced signal.

In certain embodiments, a poromechanic signal is differentiated from a direct pressure signal due to direct fluid communication through a fault or high permeability network. Pressure signals induced by direct fluid communication through a fault or high permeability network often have faster time rate of changes of pressure in the observation wellbore (e.g., the time period for the pressure signal to rise to its peak pressure).

In certain embodiments, The pressure signals due to direct fluid communication through the fault or high permeability network have the distinguishing characteristic that when pressure is observed in the observation wellbore where the pressure gauge is only in direct fluid communication with one observation stage, stimulation of a series of consecutive stages in a stimulation wellbore may yield a series of similar peak pressure responses (e.g., similar absolute magnitudes of the peak pressure in the observation stage).

In certain embodiments, a poromechanic signal is differentiated from a natural fracture or low-permeability channel which allows for fluid communication using the rate of pressure change after stimulation in the stimulation wellbore is stopped or ceased (e.g., near the end of the injection stage).

In certain embodiments, after one or more pressure-induced poromechanical signals are identified, process 200, as shown in FIG. 2, includes assessing one or more properties of the subsurface formation and/or the fracturing process in 228 (e.g., assessing the pressure-induced poromechanic signals identified in 226). For example, a geometric parameter of the stimulation wellbore fracture may be assessed from a pressure-induced poromechanical signal and/or an area of overlap between a projection orthogonal to the observation wellbore fracture and a projection orthogonal to the stimulation wellbore fracture may be assessed from the pressure-induced poromechanical signal. Analyzing hydraulic fracture geometries using the identified pressure-induced poromechanical signals may provide a more accurate analysis of the hydraulic fracture geometry than current techniques known in the art.

In some embodiments, a computer algorithm that accounts for poromechanics is used to assess properties of the subsurface formation from the pressure-induced poromechanical signal. The method of analyzing (assessing) the pressure-induced poromechanical signal data may include a number of methods involving computer simulations. In some embodiments, hydraulic fracturing commercial simulators are used in conjunction with the pressure data and inputs such as rate, pressure, injection duration, and volume into the adjacent wellbore to simulate hydraulic fracture growth and estimate the fracture geometry.

In certain embodiments, an advanced simulation tool, which couples poromechanics with transport to capture the total induced pressure signal that could be seen in the observation fracture from the monitor wellbore from a newly induced fracture in the adjacent well, is used. The above mentioned simulators for instance may use a coupled finite element-finite volume (FE-FV) scheme for more accurate analysis and a parametric study could be undertaken to develop a contour plot to evaluate the geometry of hydraulic fractures more precisely by simply using the observed pressure response. With this type of method, both the overlap and the distance between fractures (spacing of fractures) may be assessed with information obtained from the assessed pressure changes in the monitor wellbore.

In certain embodiments, the analysis of the recorded pressure data includes coupling solid mechanics and pressure diffusion equations to obtain pressure maps. A solid mechanics equation is an equation that accounts for equilibrium and satisfies a constitutive relation between stress and strain. Solid mechanics equations may be used to describe the deformation of a body under varying boundary conditions. A pressure diffusion equation is an equation that accounts for mass conservation and describes the motion of a fluid. Pressure diffusion equations may be used to describe how a fluid will react to a change in a boundary condition (e.g., a change in fluid pore pressure). In some embodiments, the coupling between the solid mechanics equation and the pressure diffusion equation is one-way. In some embodiments, the coupling between the solid mechanics equation and the pressure diffusion equation is two-way.

"Coupling", as defined herein in relation to equations, is the act of passing information. Therefore, in the case of one-way coupling, information from one equation is used in the other equation. For example, in one embodiment, at a given location, pressure may be solved for in the pressure diffusion equation. The solved for pressure may then be used in the solid mechanics equation. In another embodiment, a mechanics equation may be used to only solve for volumetric strain and then use strain in combination with a correlation to get a pore pressure increase in the pressure diffusion equation. In the case of two-way coupling, the same information is used in both equations. For example, the pressure term may be used in both the solid mechanics equation and the pressure diffusion equation. Likewise, the porosity may be used in both equations. The equations may be solved simultaneously in what is termed a fully-coupled solution or solved iteratively in a sequential solution or solved using an alternative scheme.

The simulation may reproduce the poromechanical pressure increase that may be expected in an observation fracture, at a certain distance to a second fracture, which is pressurized/dilated/propagating. A series of such simulations for various distances between the two fractures may be conducted and the resulting normalized pressure increase is then displayed on a surface plot spanned in a normalized space of fracture overlap and fracture offset. These maps may be very sensitive to the fracture geometry (e.g., the fracture height). The combination of the measured pressure signals and the surface plots for different fracture height to length ratios may provide the final geometry of the hydraulic fracture in the subsurface. In some embodiments, the surface envelope of stimulated reservoirs volumes may be used, instead of the planar fractures, for the generation of these pressure maps.

Figure 8:
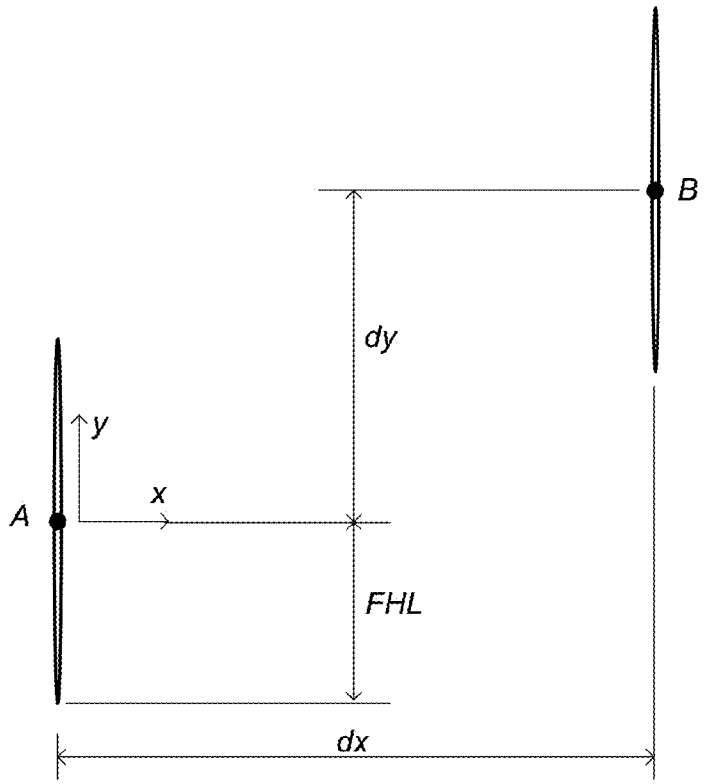
FIG. 8 depicts a plan view for an embodiment of a setup of the hydraulic fracture geometries used to generate a Pore Pressure Map.

Each fracture stage may have a distance to the observation fracture, which can be described in a local coordinate system. This distance can be inferred or approximated based on the spatial location of the stages. The local coordinate system may be transferred into the coordinate system used in the pore pressure maps. FIG. 8 depicts a plan view for an embodiment of a setup of the hydraulic fracture geometries used to generate a Pore Pressure Map.

The discretized domain is 4000 ft×4000 ft×2000 ft (width×length×height). The x/y plane acts as a symmetry plane. In the center of the plan view, a fracture in the form of an ellipsoid is incorporated, representing the predefined geometry of a newly created hydraulic fracture at its final stage with an assumed fracture half length (FHL). At a distance (dx, dy) from its origin, a second fracture is placed representing an observation fracture in the monitor wellbore (in direct fluid communication with a surface pressure gauge). This second fracture is assumed to have the same geometry, for simplicity, in this conceptual example. It is also assumed to be parallel to the first fracture and has its origin in the same z-coordinate. The long axes of the fractures are aligned with the y-direction and the height is aligned with the z-direction. The fracture height is varied in this study to explore the influence of the fracture height on the poromechanical (poroelastic) pressure response. As shown in FIG. 8, "A" represents the observation fracture, and "B" represents the stimulated or pressurized fracture. The offset and overlap between the observation fracture (A) and the stimulated or pressurized fracture (B) are defined as follows:

$$\text{overlap}=1-dy/2\text{FHL}; \text{ and}$$

$$\text{offset}=dx/2\text{FHL};$$

wherein "dx" represents a distance between the center of the observation fracture (A) and the center of the stimulated or pressurized fracture (B) along an x-axis, "dy" represents a distance between the center of the observation fracture (A) and the center of the stimulated or pressurized fracture (B) along an y-axis, "FHL" represents the Fracture Half Length of the observation fracture (A).

The calculations may be setup such that the initial stresses are applied and the displacements are zero. Hence, the simulation starts from an equilibrium state of an undeformed system. Pressure is then continuously increased in the stimulated fracture starting from the minimum horizontal stress and reaching the maximum pressure. The loading of the fracture walls, over the time interval it takes for a stimulation stage, results in a volumetric increase of the fracture, which compresses the adjacent fluid saturated porous rock. This compressional volumetric strain increases the pore pressure in the surrounding matrix due to the semi-undrained conditions in ultra-low permeability systems. The transient pressure response in the observation fracture is the result of a single simulation and is the basis for the further analysis.

Figure 9:
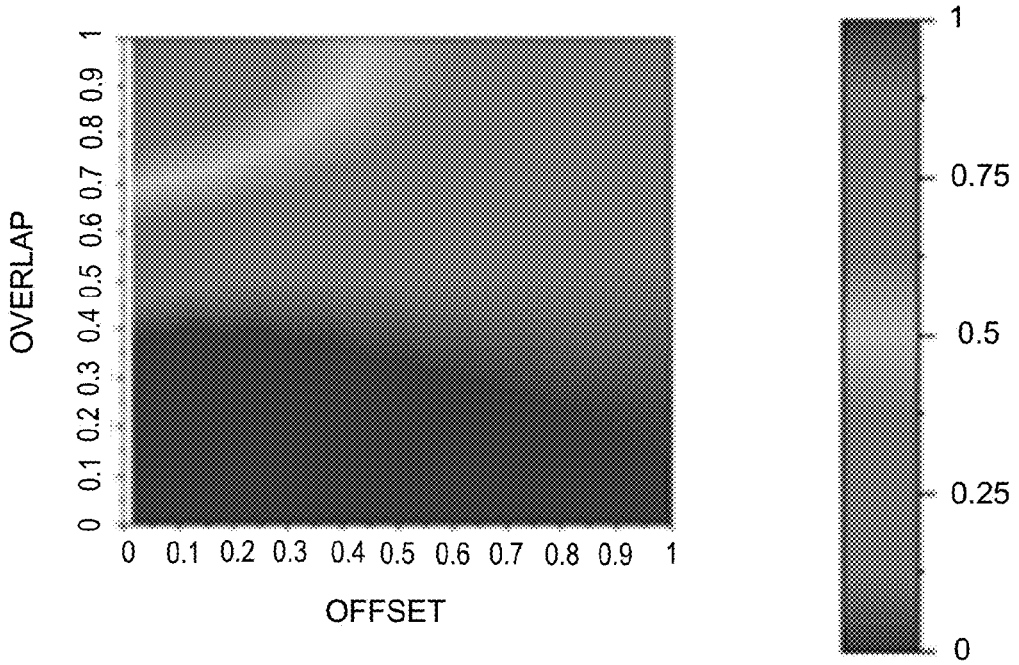
FIG. 9 depicts a Pore Pressure Map.

The next step includes performing a series of such simulations for various distances (dx and dy) of pressurized and observation fractures in a systematic way. For ease of plotting, the relative positions of the induced fracture and observation fracture in x and y coordinates are normalized to an offset dx/2FHL and an overlap (1−dy/2FHL). The corresponding pressure increase in the observation wellbore is normalized by the net-pressure. The normalized pressures at certain times for each of the simulation may then be plotted as surface plots in so called pore pressure maps as shown in FIG. 9. One map is created for a defined FHL/FHT ratio and a certain point in time during the stimulation.

Based on the introduced coordinate system above (dx, dy into offset and overlap), the top to bottom of each stage can be plotted on the pore pressure map. The series of stages is displayed as a trace across the pore pressure map. The measured pressure increases from the individual stages are normalized with the net pressure applied in the stimulated stage to identify the contour. In order to fit the monitored pore pressure increase along the trace to the map, either FHL or the FHL/FHT ratio needs to be varied. It should be noted that variation of FHL results mainly in a shift of the trace of the stages along the overlap direction. Pressure maps for different FHL/FHT ratios are then combined with varying assumptions on fracture half-length and offsets.

FIG. 9 depicts an embodiment of a Pore Pressure Map. The Pore Pressure Map shows history match of poroelastic (poromechanical) pressure response observed in a series of stages of a stimulated wellbore from an observation fracture in an adjacent observation wellbore. The history match provides the overlap and offset for each stage as well as the FHL/FHT ratio of 4.

The determined hydraulic fracture geometries according to the above described analysis may optimize the spacings between two or more wellbores penetrating the subterranean formation, and the forming of a further fracture emanating from the adjacent wellbore(s). In some embodiments, the analysis uses information related to the Young's modulus of the subterranean formation, the Poisson's ratio of the subterranean formation, the porosity of the subterranean formation, the compressibility and viscosity of the fluid in the subterranean formation, the Biot coefficient of the subterranean formation, the Young's modulus of the matter in the fracture created in the adjacent wellbore(s) while monitoring the pressure change in the monitoring stage, the Poisson's ratio of the matter in the fracture created in the adjacent wellbore(s) while monitoring the pressure change in the monitoring stage, the porosity of the matter in the fracture created in the adjacent wellbore(s) while monitoring the pressure change in the monitoring stage, the compressibility and viscosity of the fluid in the matter in the fracture created in the adjacent wellbore(s) while monitoring the pressure change in the monitoring stage, and the Biot coefficient of the matter in the fracture created in the adjacent wellbore(s) while monitoring the pressure change in the monitoring stage.

In certain embodiments, process 200, shown in FIG. 2, includes adjusting one or more operation parameters for forming fractures in the hydrocarbon-bearing subsurface formation in 230. The assessed parameters of the formation (e.g., geometric parameters) and/or the identified pressure-induced poromechanical signals may be used to adjust the operation parameters for forming fractures in the hydrocarbon-bearing subsurface formation. For example, in some embodiments, the volume of injection fluid (or sand) may be changed based on the poromechanical signal or parameters assessed from the poromechanical signal. The volume may be changed in a future stage of the current stimulation wellbore or in a different wellbore later used in the subsurface formation.

Examples of other operation parameters that may be adjusted in 230 include, but are not limited to:

(a) Selecting or changing fluids based on the poromechanical signal or parameters assessed from the poromechanical signal;
(b) Real-time completion refinement;
(c) Optimizing wellbore spacing and/or targets;
(d) Fracture orientation and horizontal stress optimization;
(e) Refracturing design and optimization;
(f) Assessment of EOR (enhanced oil recovery) potential;
(g) Design enhancements (e.g., diverter use);
(h) Evaluate impact of depleted wellbores; and
(i) Create decline curves and production forecasts.

In some embodiments, different types of fracture geometries and different spatial relationships between stimulated fractures and the observation fracture may produce similar (e.g., substantially the same) poroelastic pressure signal response in the observation fracture. For example, a stimulated fracture that is 1000 feet away in the orthogonal direction from the observation fracture and is 100 feet high and 1000 feet long with a net pressure applied of 100 psi may produce the same poroelastic pressure signal in the observation fracture as a stimulated fracture that is 500 feet away in the orthogonal direction and is 50 feet high and 50 feet long with the same net pressure applied (100 psi).

In certain embodiments, both fracture geometry (e.g., hydraulic fracture geometry) and spatial positioning of stimulated fractures relative to the observation fracture are obtained using two or more pressure measurements. Using two or more pressure measurements may provide more accurate assessments of fracture geometry and spatial positioning of stimulated fractures relative to the observation fracture. For the two (or more) pressure measurements, a first pressure measurement may be obtained during formation of a first stimulated fracture while a second pressure measurement is obtained during formation of a second stimulated fracture. Thus, the first pressure measurement assesses pressure induced by the first stimulated fracture and the second pressure measurement assesses pressure induced by the second stimulate fracture.

Figure 10:
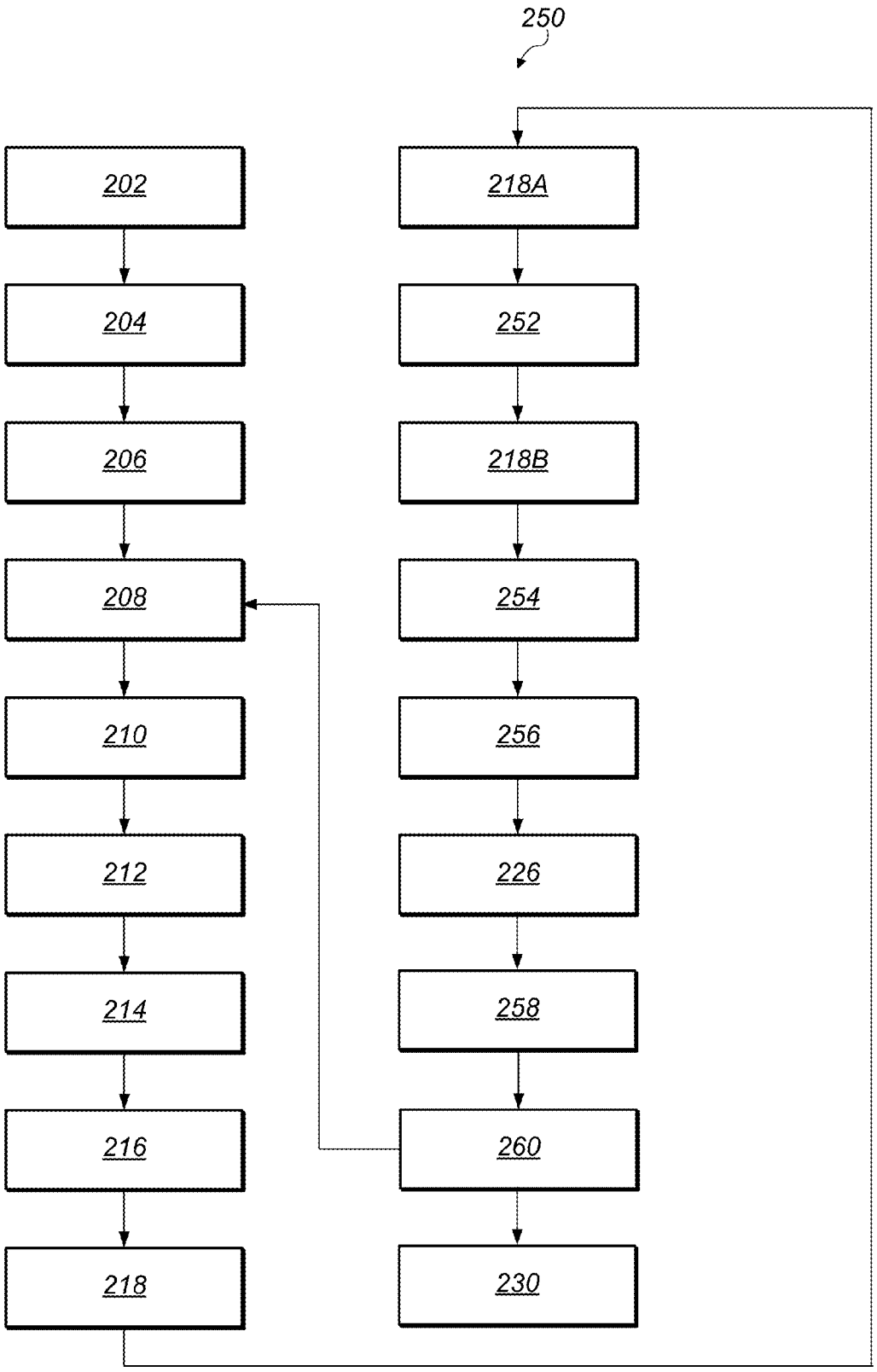
FIG. 10 depicts a flowchart of an embodiment of a process for assessing pressure signal data of two pressure signals used to evaluate hydraulic fracturing in a hydrocarbon-bearing subsurface formation.

FIG. 10 depicts a flowchart of an embodiment of process 250 for assessing pressure signal data of two pressure signals used to evaluate hydraulic fracturing in hydrocarbon-bearing subsurface formation 112. In certain embodiments, process 250 is used to assess pressure between two wellbores in formation 112. In some embodiments, however, process 250 is used to assess pressure between three or more wellbores and/or wellbores in multiple groups of wellbores in formation 112.

In certain embodiments, process 250 includes steps 202-218 from the embodiment of process 200, shown in FIG. 2. In 218A, a first fracture may be formed from the adjacent wellbore. The first fracture may be formed from a first interval (e.g., a first stage) in the adjacent wellbore. While the first fracture is being formed, a first measured pressure in the monitoring (observation) wellbore may be recorded (measured or assessed) by the pressure sensor in 252. Thus, the first measured pressure includes a pressure change induced by formation of the first fracture from the adjacent wellbore.

After the first fracture is formed, in 218B, a second fracture may be formed from the adjacent wellbore. The second fracture may be formed from a second interval (e.g., a second stage) in the adjacent wellbore. In certain embodiments, the second interval is spatially separated from the first interval in the adjacent wellbore (e.g., the intervals are separate and distinct from each other). In 254, a second measured pressure may be recorded (measured or assessed) by the pressure sensor while the second fracture is being formed. Thus, the second measured pressure includes a pressure change induced by formation of the second fracture from the adjacent wellbore.

Figure 11:
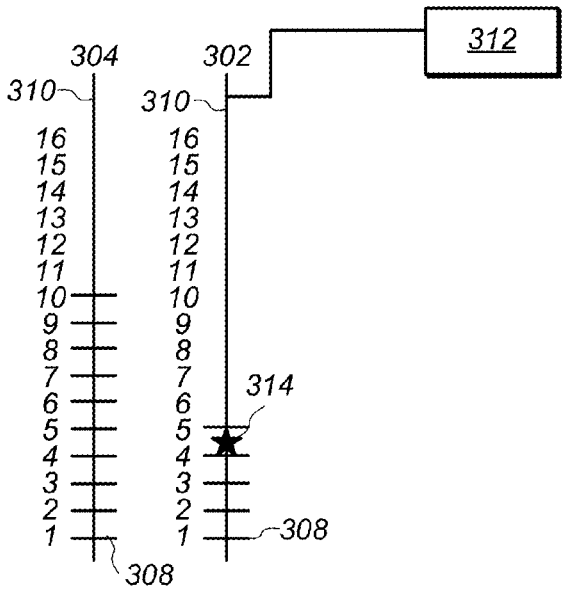
FIG. 11 depicts a diagram of an example of an embodiment of the stage sequencing and multiple pressure measurement of a hydraulic fracturing operation for a multi-well pad.

FIG. 11 depicts a diagram of an example of an embodiment of the stage sequencing and multiple pressure measurement of a hydraulic fracturing operation for a multi-well pad. In certain embodiments, wellbore 302 is the observation (monitoring) wellbore and wellbore 304 is the adjacent stimulation wellbore while horizontal lines 308 intersecting vertical lines 310 illustrate fractures created in each wellbore. In wellbore 302, stage 5 is the observation stage and is isolated as described herein. After isolation of stage 5 in wellbore 302, the valve connecting pressure gauge 312 to the wellbore is opened such that the pressure gauge is in direct fluid communication with the isolated stage 5 in the wellbore. After the valve for connecting pressure gauge 312 to wellbore 302 is opened and the pressure gauge is in direct fluid communication with the isolated stage 5 in the wellbore, fracturing in wellbore 304 may begin with the pressure gauge measuring pressure changes induced by different fractures formed from wellbore 304.

In certain embodiments, two or more pressure measurements for different fractures formed from wellbore 304 are measured by pressure gauge 312. As an example, for a first pressure measurement, pressure gauge 312 may measure pressure induced by a first stimulated fracture being formed that emanates from stage 3 in wellbore 304 (e.g., stage 3 is a first interval of the wellbore). For a second pressure measurement, pressure gauge 312 may measure pressure induced by a second stimulated fracture being formed that emanates from stage 4 in wellbore 304 (e.g., stage 4 is a second interval of the wellbore). In some embodiments, the second stimulated fracture emanates from another stage (e.g., stage 5 or stage 6) in wellbore 304.

As shown in FIG. 10, after the first pressure measurement and the second pressure measurement are recorded in 252 and 254, respectively, the spatial locations (positions) of the intervals (e.g., stages) from which the fractures originate may be assessed in 256. In certain embodiments, the spatial locations of parts of the intervals are assessed relative to the observation fracture. The spatial originations of the first stimulated fracture and/or the second stimulated fracture may be inferred (or approximated) based on the assumption that the first fracture propagates in a first direction from the first stage and the second fracture propagates in a second direction from the second stage and that the spatial locations of the stages relative to the observation stage are known. The spatial locations between stages may be described by the offsets between stages (either offsets between stages in the same wellbore or offsets between stages in different wellbores). In some embodiments, the offset between stages may be the same as the offset between fractures when the offset is defined as the distance between two lines passing through the two stages and where the two lines are parallel to the direction of maximum horizontal stress. The spatial locations may be described using the coordinate system that relates to the surface plots for different fracture height to length ratios generated from simulations described herein. Thus, the spatial locations of the parts of the intervals may be described using the coordinate system associated with the surface plots.

In some embodiments, process 250 includes identifying one or more pressure-induced poromechanic signals in the pressure signals measured in 252 and 254. In 226, similar to the embodiment of 226 in process 200, depicted in FIG. 2, pressure-induced poromechanic signals may be identified using pressure signals (e.g., a pressure log) assessed in 252 and 254. After the pressure-induced poromechanic signals are identified in 226, process 250, shown in FIG. 10, may include assessing one or more geometric parameters of the stimulated fractures in 258. In certain embodiments, the geometric parameters of the stimulated fractures are assessed using the first pressure measurement and the second pressure measurement in combination with the assessed spatial locations of the parts of the intervals in the stimulation (adjacent) wellbore. In some embodiments, pressure-induced poromechanical signals identified in the first and second pressure measurements are used in combination with the assessed spatial positioning of the stimulated fractures relative to the observation fracture to assess the geometric parameters of the stimulated fractures. In certain embodiments, surface plots for different fracture height to length ratios generated from simulations, as described herein, are used in combination with the identified pressure-induced poromechanical signals and the assessed spatial positioning of the stimulated fractures relative to the observation fracture to determine the geometric parameters of the stimulated fractures. Using two pressure measurements (and/or two identified pressure-induced poromechanical signals) may provide a more accurate solution for the hydraulic fracture geometries of the stimulated fractures.

In some embodiments, in 258, one or more geometric parameters of the observation fracture are assessed. For example, geometric parameters of the observation fracture may be assessed using the first pressure measurement and the second pressure measurement in combination with the assessed spatial locations of the parts of the intervals in the stimulation (adjacent) wellbore. In some embodiments, a change in the geometric parameters over a period of time are determined and/or information related to planar fractures and complex fracture networks are distinguished.

After the pressure measurement and geometric parameter assessment is completed, the valve connecting the pressure gauge and the monitoring wellbore may be closed in 260. Further fracturing operations may then be performed in the next stage in the monitoring wellbore. In 260, a determination may be made to decide whether more data is needed, and if yes, one or more steps in process 250 (including steps 208-260) may be repeated as many times as desired. The repeating operation may start with selecting a new observation stage. In certain embodiments, two or three observation stages are selected for process 250 in one monitoring wellbore. In some embodiments, however, more than one monitoring wellbore may be used, and in such embodiments, one observation stage per monitoring wellbore may be sufficient.

In certain embodiments, process 250, shown in FIG. 10, includes adjusting one or more operation parameters for forming fractures in the hydrocarbon-bearing subsurface formation in 230. The assessed parameters of the formation (e.g., geometric parameters) and/or the spatial positioning of the stimulated fractures relative to the observation fracture may be used to adjust the operation parameters for forming fractures in the hydrocarbon-bearing subsurface formation. Operation parameters may be adjusted for later-formed stages in the same stimulation wellbore and/or in different stimulation wellbores in the hydrocarbon-bearing subsurface formation or another subsurface formation with similar properties.

Figure 12:
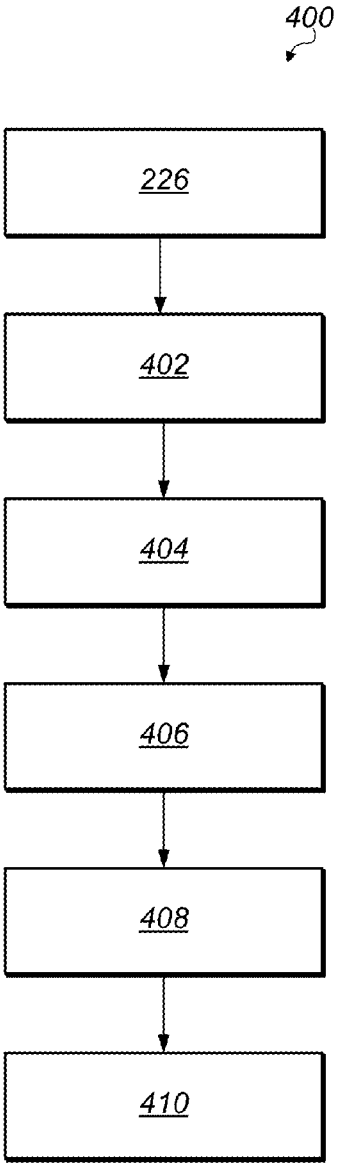
FIG. 12 depicts a flowchart of an embodiment of a process for assessing geometric parameters from pressure signal data with two pressure signal measurements in a hydrocarbon-bearing subsurface formation.

In certain embodiments, after the pressure-induced poromechanic signals are identified in 226 in process 250, assessing geometric parameters in 258 may include a process that solves for geometries that give the least (or minimum error) between simulated pressure signals and actual measured pressure signals (e.g., pressure signals measured by the pressure sensor). FIG. 12 depicts a flowchart of an embodiment of process 400 for assessing geometric parameters from pressure signal data with two pressure signal measurements in a hydrocarbon-bearing subsurface formation. In process 400, after pressure-induced poromechanic signals are identified in 226, a series of simulations may be developed in 402. The series of simulations may be developed to describe expected poromechanical responses (e.g., poromechanical pressure increases) as a function of spatial relationship between the fractures (e.g., offset and overlap), fracture height, fracture length (which may be tied to overlap if the well spacing is known), fracture geometry, and/or net pressure applied in the stimulation wellbore conducted to produce one or more surface plots in 402. In some embodiments, an angle or the direction of fracture propagation may also be used in determining the spatial relationship between fractures (e.g., offset and overlap). In certain embodiments, the series of simulations include surface plots that may be used to determine the expected poromechanical responses. In certain embodiments, the surface plots provide expected poromechanical responses for a plurality of fracture geometries. For example, the surface plots may provide all the expected poromechanical responses for the plurality of fracture geometries (e.g., the surface plots include all the expected poromechanical responses for any fracture geometry that may be expected during a fracture process).

After the simulations are developed in 402, a single (average) fracture geometry may be determined for all the fractures (e.g., the stimulated fractures and the observation fracture) in sub-process 404. In certain embodiments, the single geometry for all the fractures provides the least (minimum) error between the measured pressure signals (e.g., the identified pressure-induced poromechanic signals) and simulated pressure signals determined using the simulations developed in 402. In certain embodiments of sub-process 404, one or more fracture geometries (e.g., simulated fracture geometries) are used in the simulations to determine simulated pressure signals (e.g., simulated pressure-induced poromechanic signals). The simulated pressure signals may then be compared to the measured pressure signals to determine the error in the pressure signals. The simulated fracture geometry that provides the least (e.g., smallest or minimum) error in the simulated pressure signals may then be the single fracture geometry determined for all the fractures in 404.

Figure 13:
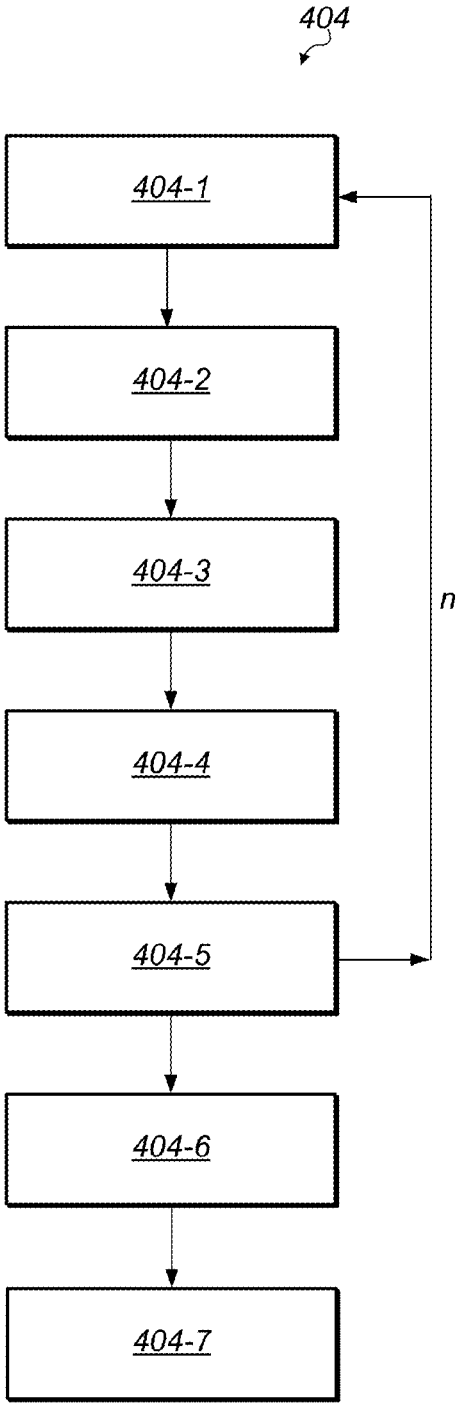
FIG. 13 depicts a flowchart of an embodiment of a process for determining a single geometry.

FIG. 13 depicts a flowchart of an embodiment of sub-process 404 for determining the single fracture geometry for all the fractures. In certain embodiments, sub-process 404 includes selecting a first simulated fracture geometry from a plurality of simulated fracture geometries in 404-1. The plurality of simulated fracture geometries may include the fracture geometries included in the simulations developed in 402 in process 400, shown in FIG. 12. The simulated fracture geometries may include, for example, simulated shapes, heights, and lengths for the stimulated fractures with simulated spatial relationships (e.g., overlaps and offsets) between the stimulated fractures. In sub-process 404, as shown in FIG. 13, the first simulated fracture geometry may be used to determine a first simulated pressure signal for a first fracture in 404-2. The first fracture may be, for example, the fracture responsible for the first pressure signal measured in 252 in process 250, shown in FIG. 10. In certain embodiments, the first simulated pressure signal is determined for the first simulated fracture geometry based on a spatial relationship (e.g., offset) between the first fracture emanating from the stimulation wellbore and the observation fracture (e.g., the spatial relationship may be the offset between the first fracture stage in wellbore 304 and the observation stage in wellbore 302, depicted in FIG. 11) and the net pressure applied in the stimulation wellbore.

For the first simulated pressure signal found in 404-2, a second simulated pressure signal for a second fracture emanating from the stimulation wellbore may be determined in 404-3. The second fracture may be, for example, the fracture responsible for the second pressure signal measured in 254 in process 250, shown in FIG. 10. In certain embodiments, the second simulated pressure signal is determined for the first simulated fracture geometry based on a spatial relationship (e.g., offset) between the second fracture emanating from the stimulation wellbore and the observation fracture (e.g., the spatial relationship may be the offset between the second fracture stage in wellbore 304 and the observation stage in wellbore 302, depicted in FIG. 11) and the net pressure applied in the stimulation wellbore. In some embodiments, the spatial relationship between the second fracture and the observation fracture is determined using the spatial relationship between the first interval (stage) and the second interval (stage) in the stimulation wellbore (e.g., the spatial relationship between the intervals from which the stimulation fractures emanate).

After the first simulated pressure signal and the second simulated pressure signal are determined for the first simulated fracture geometry, the absolute errors for the simulated pressure signals may be determined in 404-4, as shown in FIG. 13. In 404-4, a first absolute error may be determined for the first simulated pressure signal and a second absolute error may be determined for the second simulated pressure signal. The first absolute error may be determined by comparing the first simulated pressure signal to the first pressure signal measured in 252. The second absolute error may be determined by comparing the second simulated pressure signal to the second pressure signal measured in 254. In 404-5, a total absolute error may be determined for the first simulated fracture geometry. The total absolute error may be the sum of the first absolute error and the second absolute error.

In certain embodiments, steps 404-1 through 404-5 may be repeated for n number of simulated fracture geometries, as shown in FIG. 13. For example, steps 404-1 through 404-5 may be repeated for each simulated fracture geometry in the plurality of simulated fracture geometries developed in 402 in process 400, shown in FIG. 12. Thus, n number of total absolute error values may be determined in 404-5. In 404-6, the smallest absolute error value may be determined (e.g., the minimum error value may be found for the simulated fracture geometries). In 404-7, the simulated fracture geometry that provides the smallest absolute error value may be determined as the single fracture geometry determined for all the fractures in sub-process 404. The single fracture geometry may be determined for the first fracture and used as an average fracture geometry for all the fractures (e.g., the first fracture, the second fracture, and the observation fracture).

In certain embodiments, as shown in FIG. 11, after the single fracture geometry for all the fractures is determined in sub-process 404, the single fracture geometry may be used to refine the fracture geometry for the first fracture in sub-process 406. In sub-process 406, the single fracture geometry determined in sub-process 404 may be used to determine a selected simulated fracture geometry for the first fracture. The selected simulated fracture geometry for the first fracture may be the fracture geometry that provides a selected minimum (e.g., the minimum) error between a refined first simulated pressure signal and the first pressure signal measured in 252.

Figure 14:
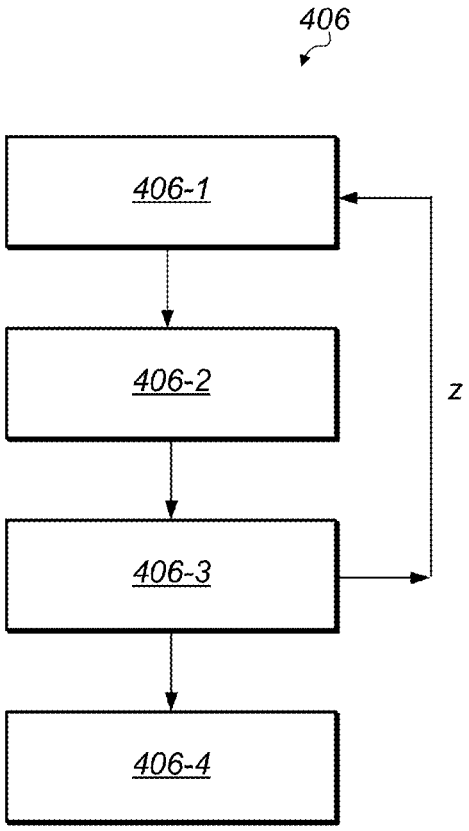
FIG. 14 depicts a flowchart of an embodiment of a process for determining a refined geometry of a fracture.

FIG. 14 depicts a flowchart of an embodiment of sub-process 406 for determining a refined geometry of the first fracture. In 406-1, a geometric parameter (e.g., height or length) for the single fracture geometry determined in sub-process 404 may be multiplied by a selected value to provide a new simulated fracture geometry for the first fracture. In 406-2, the new simulated fracture geometry for the first fracture may be used to determine a first, refined first simulated pressure signal for the first fracture.

In 406-3, the absolute error between the first, refined first simulated pressure signal and the first pressure signal measured in 252 may be determined for the new simulated fracture geometry for the first fracture determined in 406-2. Steps 406-1 through 406-3 may be repeated for z number of iterations. The number of iterations, z, may be a selected number of increments between a minimum selected value and a maximum selected value. For example, in some embodiments, the selected value is a selected percentage and the selected percentage may range between a minimum percentage of 1% and a maximum percentage of 1000%. Thus, the number of iterations, z, selected between 1% and 1000% may provide z simulated fracture geometries and z absolute errors that are assessed in sub-process 406.

In 406-4, the new simulated fracture geometry for the first fracture that has the minimum absolute error may be selected as the selected (refined) simulated fracture geometry for the first fracture determined by sub-process 406. In some embodiments, the single fracture geometry determined in sub-process 404 may be multiplied by a selected value to provide a new simulated fracture geometry for the observation fracture and the first fracture. The new simulated fracture geometry for the observation fracture and the first fracture may then be used to determine the selected (refined) simulated fracture geometry for the first fracture as described above.

In certain embodiments, the single fracture geometry determined in 404 may be used to refine the fracture geometry of the second fracture in sub-process 408. For example, the single geometry determined in 404 may be used to determine a selected simulated fracture geometry for the second fracture. The selected simulated fracture geometry for the second fracture may be the fracture geometry that provides a selected minimum (e.g., the minimum) error between a refined second simulated pressure signal and the second pressure signal measured in 254. Sub-process 408 for determining the selected simulated fracture geometry for the second fracture may be substantially similar to sub-process 406 used for the first fracture. Sub-process 408 may include multiplying the single fracture geometry to provide a new simulated fracture geometry for the second fracture or for the observation fracture and the second fracture as described above.

In some embodiments, the single fracture geometry determined in 404 may be used to refine the fracture geometry of the observation fracture in sub-process 410. For example, the single geometry determined in 404 may be used to determine a selected simulated fracture geometry for the observation fracture. The selected simulated fracture geometry for the observation fracture may be the fracture geometry that provides a selected minimum (e.g., the minimum) error between the refined first simulated pressure signal and/or the refined second simulated pressure signal and the corresponding pressure signals measured in 252 and 254. Sub-process 410 for determining the selected simulated fracture geometry for the observation fracture may be substantially similar to sub-process 406 used for the first fracture. In some embodiments, the selected simulated fracture geometry for the observation fracture may be the single fracture geometry determined in sub-process 404.

Refining the fracture geometries for the stimulation fractures and the observation fractures in sub-processes 406, 408, and 410 may minimize the overall total error between simulated pressure signals and measured pressure signals Minimizing the overall total error between simulated pressure signals and measured pressure signals may increase the accuracy of determining fracture geometries of the stimulation fractures and the observation fractures. Thus, the described processes may more accurately evaluate direct fluid communication between fracture stages as well as hydraulic fracture overlap, fracture height, and fracture spatial location.

In certain embodiments, one or more process steps described herein may be performed by one or more processors (e.g., a computer processor) executing instructions stored on a non-transitory computer-readable medium. For example, process 200 shown in FIG. 2, process 250 shown in FIG. 10, process 400 shown in FIG. 12, sub-process 404 shown in FIG. 13, and/or sub-process 406 shown in FIG. 14 may have one or more steps performed by one or more processors executing instructions stored as program instructions in a computer readable storage medium (e.g., a non-transitory computer readable storage medium).

Figure 15:
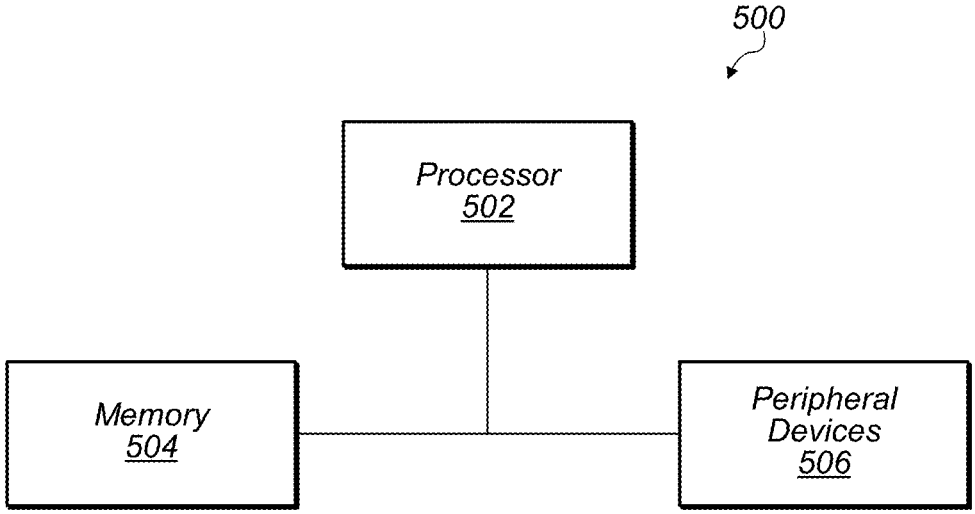
FIG. 15 depicts a block diagram of one embodiment of an exemplary computer system.

FIG. 15 depicts a block diagram of one embodiment of exemplary computer system 500. Exemplary computer system 500 may be used to implement one or more embodiments described herein. In some embodiments, computer system 500 is operable by a user to implement one or more embodiments described herein such as, but not limited to, process 200, shown in FIG. 2. In the embodiment of FIG. 15, computer system 500 includes processor 502, memory 504, and various peripheral devices 506. Processor 502 is coupled to memory 504 and peripheral devices 506. Processor 502 is configured to execute instructions, including the instructions for process 200, which may be in software. In various embodiments, processor 502 may implement any desired instruction set (e.g. Intel Architecture-32 (IA-32, also known as x86), IA-32 with 64 bit extensions, x86-64, PowerPC, Sparc, MIPS, ARM, IA-64, etc.). In some embodiments, computer system 500 may include more than one processor. Moreover, processor 502 may include one or more processors or one or more processor cores.

Processor 502 may be coupled to memory 504 and peripheral devices 506 in any desired fashion. For example, in some embodiments, processor 502 may be coupled to memory 504 and/or peripheral devices 506 via various interconnect. Alternatively or in addition, one or more bridge chips may be used to coupled processor 502, memory 504, and peripheral devices 506.

Memory 504 may comprise any type of memory system. For example, memory 504 may comprise DRAM, and more particularly double data rate (DDR) SDRAM, RDRAM, etc. A memory controller may be included to interface to memory 504, and/or processor 502 may include a memory controller. Memory 504 may store the instructions to be executed by processor 502 during use, data to be operated upon by the processor during use, etc.

Figure 16:
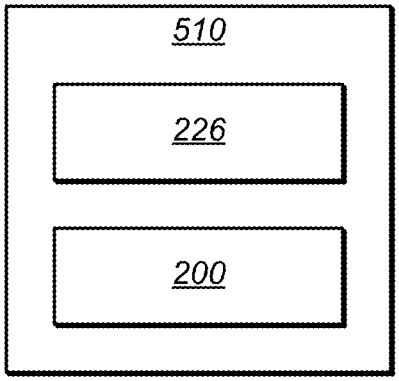
FIG. 16 depicts a block diagram of one embodiment of a computer accessible storage medium.

Peripheral devices 506 may represent any sort of hardware devices that may be included in computer system 500 or coupled thereto (e.g., storage devices, optionally including computer accessible storage medium 510, shown in FIG. 16, other input/output (I/O) devices such as video hardware, audio hardware, user interface devices, networking hardware, etc.).

Turning now to FIG. 16, a block diagram of one embodiment of computer accessible storage medium 510 including one or more data structures representative of identified pressure-induced poromechanical signals (found in 226 in process 200 depicted in FIG. 2) and one or more code sequences representative of process 200 (shown in FIG. 2) or steps in process 200 (e.g., assessing one or more properties of the subsurface formation and/or the fracturing process in 228). Each code sequence may include one or more instructions, which when executed by a processor in a computer, implement the operations described for the corresponding code sequence. Generally speaking, a computer accessible storage medium may include any storage media accessible by a computer during use to provide instructions and/or data to the computer. For example, a computer accessible storage medium may include non-transitory storage media such as magnetic or optical media, e.g., disk (fixed or removable), tape, CD-ROM, DVD-ROM, CD-R, CD-RW, DVD-R, DVD-RW, or Blu-Ray. Storage media may further include volatile or non-volatile memory media such as RAM (e.g. synchronous dynamic RAM (SDRAM), Rambus DRAM (RDRAM), static RAM (SRAM), etc.), ROM, or Flash memory. The storage media may be physically included within the computer to which the storage media provides instructions/data. Alternatively, the storage media may be connected to the computer. For example, the storage media may be connected to the computer over a network or wireless link, such as network attached storage. The storage media may be connected through a peripheral interface such as the Universal Serial Bus (USB). Generally, computer accessible storage medium 510 may store data in a non-transitory manner, where non-transitory in this context may refer to not transmitting the instructions/data on a signal. For example, non-transitory storage may be volatile (and may lose the stored instructions/data in response to a power down) or non-volatile.

Further modifications and alternative embodiments of various aspects of the embodiments described in this disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described herein are to be taken as the presently preferred embodiments. Elements and materials may be substituted for those illustrated and described herein, parts and processes may be reversed, and certain features of the embodiments may be utilized independently, all as would be apparent to one skilled in the art after having the benefit of this description. Changes may be made in the elements described herein without departing from the spirit and scope of the following claims.

What is claimed is:

1. A method for of treating a subsurface formation, comprising:

assessing a first pressure signal in a first wellbore using a pressure sensor in direct fluid communication with a first fluid in the first wellbore, wherein the first fluid in the first wellbore is in direct fluid communication with a first fracture in the subsurface formation emanating from a selected interval in the first wellbore, and wherein the first pressure signal assessed in the first wellbore includes a pressure change induced by formation of a second fracture emanating from a first interval in a second wellbore in the subsurface formation, the second fracture being in direct fluid communication with a second fluid in the second wellbore in the subsurface formation;

assessing a second pressure signal in the first wellbore using the pressure sensor in direct fluid communication with the first fluid in the first wellbore, wherein the second pressure signal assessed in the first wellbore includes a pressure change induced by formation of a third fracture emanating from a second interval in the second wellbore in the subsurface formation, the second interval in the second wellbore being spatially separated from the first interval in the second wellbore, wherein the third fracture is in direct fluid communication with a third fluid in the second wellbore in the subsurface formation;

assessing a first spatial location of a part of the first interval in the second wellbore relative to the selected interval in the first wellbore;

assessing a second spatial location of a part of the second interval in the second wellbore relative to the selected interval in the first wellbore; and assessing one or more geometric parameters of the second fracture and the third fracture using the first pressure signal and the second pressure signal in combination with the first assessed spatial location and the second assessed spatial location.

2. The method of claim 1, wherein the first spatial location comprises a first offset between the part of the first interval in the second wellbore and the selected interval in the first wellbore.

3. The method of claim 1, wherein the second spatial location comprises a second offset between the part of the second interval in the second wellbore and the selected interval in the first wellbore.

4. The method of claim 1, further comprising assessing at least one geometric parameter of the first fracture using the first pressure signal and the second pressure signal in combination with the first assessed spatial location and the second assessed spatial location.

5. The method of claim 1, further comprising:

identifying a first pressure-induced poromechanic signal in the first pressure signal; and identifying a second pressure-induced poromechanic signal in the second pressure signal.

6. The method of claim 5, wherein the one or more geometric parameters of the second fracture and the third fracture are assessed using the first pressure-induced poromechanic signal in the first pressure signal and the second pressure-induced poromechanic signal in the second pressure signal in combination with the first assessed spatial location and the second assessed spatial location.

7. The method of claim 1, further comprising assessing a change in at least one of the geometric parameters over a period of time.

8. The method of claim 1, further comprising adjusting one or more operation parameters for forming fractures in the subsurface formation based on at least one of the assessed geometric parameters of the second fracture and the third fracture.

9. The method of claim 1, further comprising generating, using a simulation on a computer processor, one or more surface plots that provide expected pressure changes in the first wellbore as a function of spatial relationships between the first fracture, the second fracture, and the third fracture.

10. The method of claim 9, wherein one or more of the geometric parameters of the second fracture are assessed by using the one or more surface plots to determine a set of simulated geometric parameters that provide a minimum error between the expected pressure change and the first pressure signal.

11. The method of claim 1, wherein the selected interval in the first wellbore is isolated from other intervals in the first wellbore.

12. The method of claim 1, wherein the first fracture does not intersect the second fracture or the third fracture.

13. A system for assessing one or more geometric parameters of fractures in a subsurface formation, comprising:

a first wellbore in the subsurface formation;

a first fracture emanating from a selected interval in the first wellbore, the first fracture being in direct fluid communication with a first fluid in the first wellbore;

a second wellbore in the subsurface formation;

a second fracture configured to be formed from a first interval in the second wellbore and in direct fluid communication with a second fluid in the second wellbore;

a third fracture configured to be formed from a second interval in the second wellbore and in direct fluid communication with a third fluid in the second wellbore, the second interval in the second wellbore being spatially separated from the first interval in the second wellbore;

a pressure sensor in direct fluid communication with the first fluid in the first wellbore; and a computer processor configured to receive one or more pressure signals from the pressure sensor, wherein the computer processor is configured to assess a first pressure signal from the pressure sensor while the second fracture is being formed and assess a second pressure signal from the pressure sensor while the third fracture is being formed, the first pressure signal being induced by formation of the second fracture and the second pressure signal being induced by formation of the third fracture, and wherein the computer processor is configured to:

assess a first spatial location of a part of the first interval in the second wellbore relative to the selected interval in the first wellbore;

assess a second spatial location of a part of the second interval in the second wellbore relative to the selected interval in the first wellbore; and assess one or more geometric parameters of the second fracture and the third fracture using the first pressure signal and the second pressure signal in combination with the first assessed spatial location and the second assessed spatial location.

14. The system of claim 13, wherein the selected interval in the first wellbore is isolated from other intervals in the first wellbore.

15. The system of claim 13, wherein the pressure sensor comprises a surface pressure gauge in direct fluid communication with the first fluid in the first wellbore.

16. A non-transient computer-readable medium including instructions that, when executed by one or more processors, causes the one or more processors to perform a method, comprising:

assessing a first pressure signal in a first wellbore using a pressure sensor in direct fluid communication with a first fluid in the first wellbore, wherein the first fluid in the first wellbore is in direct fluid communication with a first fracture in the subsurface formation emanating from a selected interval in the first wellbore, and wherein the first pressure signal assessed in the first wellbore includes a pressure change induced by formation of a second fracture emanating from a first interval in a second wellbore in the subsurface formation, the second fracture being in direct fluid communication with a second fluid in the second wellbore in the subsurface formation;

assessing a second pressure signal in the first wellbore using the pressure sensor in direct fluid communication with the first fluid in the first wellbore, wherein the second pressure signal assessed in the first wellbore includes a pressure change induced by formation of a third fracture emanating from a second interval in the second wellbore in the subsurface formation, the second interval in the second wellbore being spatially separated from the first interval in the second wellbore, wherein the third fracture is in direct fluid communication with a third fluid in the second wellbore in the subsurface formation;

assessing a first spatial location of a part of the first interval in the second wellbore relative to the selected interval in the first wellbore;

assessing a second spatial location of a part of the second interval in the second wellbore relative to the selected interval in the first wellbore; and assessing one or more geometric parameters of the second fracture and the third fracture using the first pressure signal and the second pressure signal in combination with the first assessed spatial location and the second assessed spatial location.

17. A method for of treating a subsurface formation, comprising:

assessing a first pressure signal in a first wellbore using a pressure sensor in direct fluid communication with a first fluid in the first wellbore, wherein the first fluid in the first wellbore is in direct fluid communication with a first fracture in the subsurface formation emanating from a selected interval in the first wellbore, and wherein the first pressure signal assessed in the first wellbore includes a pressure change induced by formation of a second fracture emanating from a first interval in a second wellbore in the subsurface formation, the second fracture being in direct fluid communication with a second fluid in the second wellbore in the subsurface formation;

assessing a second pressure signal in the first wellbore using the pressure sensor in direct fluid communication with the first fluid in the first wellbore, wherein the second pressure signal assessed in the first wellbore includes a pressure change induced by formation of a third fracture emanating from a second interval in the second wellbore in the subsurface formation, the second interval in the second wellbore being spatially separated from the first interval in the second wellbore, wherein the third fracture is in direct fluid communication with a third fluid in the second wellbore in the subsurface formation;

determining, using a simulation on a computer processor, a first simulated fracture geometry for the second fracture emanating from the second wellbore, wherein the first simulated fracture geometry is determined as a simulated fracture geometry selected from a plurality of simulated fracture geometries that provides a minimum in a total error between at least two simulated pressure signals and the assessed pressure signals, the total error being a sum of a first error between a first simulated pressure signal and the first assessed pressure signal and a second error between a second simulated pressure signal and the second assessed pressure signal;

wherein the first simulated pressure signal and the second simulated pressure signal are determined for the first simulated fracture geometry based on a spatial relationship between the second fracture and the first fracture, a spatial relationship between the first interval and the second interval in the second wellbore, and a net pressure applied in the second wellbore.

18. The method of claim 17, wherein determining the first simulated fracture geometry for the second fracture emanating from the second wellbore comprises:

determining the first simulated pressure signal, the first simulated pressure signal being determined using a simulated fracture geometry selected from the plurality of simulated fracture geometries;

assessing the first error between the first assessed pressure signal and the first simulated pressure signal;

determining the second simulated pressure signal, the second simulated pressure signal being determined using the simulated fracture geometry selected from the plurality of simulated fracture geometries;

assessing the second error between the second assessed pressure signal and the second simulated pressure signal;

assessing the total error for the simulated fracture geometry selected from the plurality of simulated fracture geometries;

assessing the total error for one or more additional simulated fracture geometries selected from the plurality of simulated fracture geometries;

comparing the total error for the simulated fracture geometry selected from the plurality of simulated fracture geometries and the total error for the one or more additional simulated fracture geometries selected from the plurality of simulated fracture geometries; and selecting as the first simulated fracture geometry, the simulated fracture geometry selected from the plurality of simulated fracture geometries that provides the minimum in the total error.

19. The method of claim 17, further comprising determining a selected simulated fracture geometry for the second fracture, wherein the selected simulated fracture geometry for the second fracture provides a minimum in the first error between the first simulated pressure signal and the first assessed pressure signal.

20. The method of claim 19, wherein determining the selected simulated fracture geometry for the second fracture comprises:

beginning with the first simulated fracture geometry, multiplying at least one parameter of the first simulated fracture geometry by a selected value to provide a new simulated fracture geometry for the second fracture;

multiplying at least one parameter of the first simulated fracture geometry by one or more additional selected values to provide one or more additional new simulated fracture geometries for the second fracture;

determining a set of new first simulated pressure signals for the second fracture using one or more of the new simulated fracture geometries;

assessing the first error between the first assessed pressure signal and two or more of the new first simulated pressure signals; and selecting as the selected simulated fracture geometry for the second fracture, the new simulated fracture geometry that provides the minimum in the first error between the first assessed pressure signal and the new first simulated pressure signal associated with the selected simulated fracture geometry.

21. The method of claim 17, further comprising determining a selected simulated fracture geometry for the third fracture, wherein the selected simulated fracture geometry for the third fracture provides a minimum in the second error between the second simulated pressure signal and the second assessed pressure signal.

22. The method of claim 21, wherein determining the selected simulated fracture geometry for the second fracture comprises:

beginning with the first simulated fracture geometry, multiplying at least one parameter of the first simulated fracture geometry by a selected value to provide a new simulated fracture geometry for the first fracture and the second fracture;

multiplying at least one parameter of the first simulated fracture geometry by one or more additional selected values to provide one or more additional new simulated fracture geometries for the first fracture and the second fracture;

determining a set of new first simulated pressure signals for the second fracture using one or more of the new simulated fracture geometries for the first fracture and the second fracture;

assessing the first error between the first assessed pressure signal and two or more of the new first simulated pressure signals; and selecting as the selected simulated fracture geometry for the second fracture, the new simulated fracture geometry for the first fracture and the second fracture that provides the minimum in the first error between the first assessed pressure signal and the new first simulated pressure signal associated with the selected simulated fracture geometry.

23. The method of claim 17, wherein determining the selected simulated fracture geometry for the third fracture comprises:

beginning with the first simulated fracture geometry, multiplying at least one parameter of the first simulated fracture geometry by a selected value to provide a new simulated fracture geometry for the third fracture;

multiplying at least one parameter of the first simulated fracture geometry by one or more additional selected values to provide one or more additional new simulated fracture geometries for the third fracture;

determining a set of new second simulated pressure signals for the third fracture using one or more of the new simulated fracture geometries;

assessing the second error between the second assessed pressure signal and two or more of the new second simulated pressure signals; and selecting as the selected simulated fracture geometry for the third fracture, the new simulated fracture geometry that provides the minimum in the second error between the second assessed pressure signal and the new second simulated pressure signal associated with the selected simulated fracture geometry.

24. The method of claim 17, wherein determining the selected simulated fracture geometry for the third fracture comprises:

beginning with the first simulated fracture geometry, multiplying at least one parameter of the first simulated fracture geometry by a selected value to provide a new simulated fracture geometry for the first fracture and the third fracture;

multiplying at least one parameter of the first simulated fracture geometry by one or more additional selected values to provide one or more additional new simulated fracture geometries for the first fracture and the third fracture;

determining a set of new second simulated pressure signals for the third fracture using one or more of the new simulated fracture geometries for the first fracture and the third fracture;

assessing the second error between the second assessed pressure signal and two or more of the new second simulated pressure signals; and selecting as the selected simulated fracture geometry for the third fracture, the new simulated fracture geometry for the first fracture and the third fracture that provides the minimum in the second error between the second assessed pressure signal and the new second simulated pressure signal associated with the selected simulated fracture geometry.

25. The method of claim 17, further comprising determining, beginning with the first simulated fracture geometry, a selected simulated fracture geometry for the first fracture emanating from the first wellbore, wherein the selected simulated fracture geometry for the first fracture provides the minimum in the total error between the at least two simulated pressure signals and the assessed pressure signals.

26. The method of claim 17, further comprising:

identifying a first pressure-induced poromechanic signal in the first pressure signal; and identifying a second pressure-induced poromechanic signal in the second pressure signal.

27. The method of claim 26, wherein the simulated pressure signals comprise simulated pressure-induced poromechanic signals, and wherein the errors in the simulated pressure signals comprise errors between the identified pressure-induced poromechanic signals and the simulated pressure-induced poromechanic signals.

28. The method of claim 17, further comprising adjusting one or more operation parameters for forming fractures in the subsurface formation based on at least one of the selected simulated fracture geometries.

29. The method of claim 17, wherein the selected interval in the second wellbore is isolated from other intervals in the second wellbore.

30. The method of claim 17, wherein the first pressure signal is induced by fluid pressure from fracture fluid used to form the first fracture in the first wellbore, and wherein the second pressure signal is induced by fluid pressure from fracture fluid used to form the third fracture in the first wellbore.

31. The method of claim 17, further comprising generating, using the simulation on the computer processor, one or more surface plots that provide expected pressure changes in the second wellbore as a function of spatial relationships between the first fracture, the second fracture, and the third fracture.

32. The method of claim 31, wherein the simulated pressure signals are determined from the simulated fracture geometries using at least one of the surface plots.

33. A system for assessing one or more geometric parameters of fractures in a subsurface formation, comprising:

a first wellbore in the subsurface formation;

at least a first fracture emanating from a selected interval in the first wellbore, the first fracture being in direct fluid communication with a first fluid in the first wellbore;

a second wellbore in the subsurface formation;

a second fracture configured to be formed from a first interval in the second wellbore and in direct fluid communication with a second fluid in the second wellbore;

a third fracture configured to be formed from a second interval in the second wellbore and in direct fluid communication with a third fluid in the second wellbore, the second interval in the second wellbore being spatially separated from the first interval in the second wellbore;

a pressure sensor in direct fluid communication with the first fluid in the first wellbore; and a computer processor configured to receive one or more pressure signals from the pressure sensor, wherein the computer processor is configured to assess a first pressure signal from the pressure sensor while the second fracture is being formed and assess a second pressure signal from the pressure sensor while the third fracture is being formed, the first pressure signal being induced by formation of the second fracture and the second pressure signal being induced by formation of the third fracture, and wherein the computer processor is configured to:

determine, using a simulation on the computer processor, a first simulated fracture geometry for the second fracture emanating from the second wellbore, wherein the first simulated fracture geometry is determined as a simulated fracture geometry selected from a plurality of simulated fracture geometries that provides a minimum in a total error between at least two simulated pressure signals and the assessed pressure signals, the total error being a sum of a first error between a first simulated assessed pressure signal and the first pressure signal and a second error between a second simulated pressure signal and the second assessed pressure signal;

wherein the first simulated pressure signal and the second simulated pressure signal are determined for the first simulated fracture geometry based on a spatial relationship between the second fracture and the first fracture, a spatial relationship between the first interval and the second interval in the second wellbore, and a net pressure applied in the second wellbore.

34. The system of claim 33, wherein the selected interval in the first wellbore is isolated from other intervals in the first wellbore.

35. The system of claim 33, wherein the pressure sensor comprises a surface pressure gauge in direct fluid communication with the first fluid in the first wellbore.

36. The system of claim 33, wherein the computer processor is configured to determine, beginning with the first simulated fracture geometry, a selected simulated fracture geometry for the second fracture, wherein the selected simulated fracture geometry for the second fracture provides a minimum in the first error between the first simulated pressure signal and the first assessed pressure signal.

37. The system of claim 33, wherein the computer processor is configured to determine, beginning with the first simulated fracture geometry, a selected simulated fracture geometry for the third fracture, wherein the selected simulated fracture geometry for the third fracture provides a minimum in the second error between the second simulated pressure signal and the second assessed pressure signal.

* * * * *